US008937583B2

(12) United States Patent
Yamamoto et al.

(10) Patent No.: US 8,937,583 B2
(45) Date of Patent: Jan. 20, 2015

(54) DISPLAY APPARATUS, DRIVING METHOD FOR DISPLAY APPARATUS AND ELECTRONIC APPARATUS

(75) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 1473 days.

(21) Appl. No.: 12/292,181

(22) Filed: Nov. 13, 2008

(65) Prior Publication Data

US 2009/0122047 A1 May 14, 2009

(30) Foreign Application Priority Data

Nov. 14, 2007 (JP) ..... 2007-295555
Oct. 6, 2008 (JP) ..... 2008-259166

(51) Int. Cl.
*G09G 3/30* (2006.01)
*G09G 3/32* (2006.01)

(52) U.S. Cl.
CPC ..... *G09G 3/3266* (2013.01); *G09G 3/3233* (2013.01); *G09G 3/3291* (2013.01); *G09G 2300/0819* (2013.01); *G09G 2300/0842* (2013.01); *G09G 2300/0866* (2013.01); *G09G 2310/0218* (2013.01); *G09G 2310/0283* (2013.01); *G09G 2320/043* (2013.01)
USPC ..... 345/77; 345/76; 345/78

(58) Field of Classification Search
CPC ..... G09G 3/30; G09G 3/3266; G09G 3/3233; G09G 3/3291; G09G 2300/0866; G09G 2300/0842; G09G 2300/0819; G09G 2310/0283; G09G 2310/043; G09G 2310/0281
USPC ..... 345/211, 76–79, 82; 315/169.3; 313/483
See application file for complete search history.

(56) References Cited

U.S. PATENT DOCUMENTS

2003/0043097 A1* 3/2003 Shingai et al. ..... 345/87
2005/0212746 A1* 9/2005 Iwasaki et al. ..... 345/100
2007/0115225 A1* 5/2007 Uchino et al. ..... 345/76
2008/0094320 A1* 4/2008 Parikh et al. ..... 345/76

FOREIGN PATENT DOCUMENTS

JP 2003-122303 A 4/2003
JP 2003-255856 A 9/2003

(Continued)

OTHER PUBLICATIONS

Japanese Office Action issued Nov. 6, 2012 for corresponding Japanese Application No. 2005-259166.

*Primary Examiner* — Jonathan Horner
(74) *Attorney, Agent, or Firm* — Rader, Fishman & Grauer PLLC

(57) ABSTRACT

The present invention provides a display apparatus, includes: a pixel array section including a plurality of scanning lines disposed in rows, a plurality of signal lines disposed in columns, and a plurality of pixels arranged in rows and columns at places at which the scanning lines and the signal lines intersect with each other; and a driving section configured to drive the pixels through the scanning lines and the signal lines; the driving section carrying out block-sequential driving wherein the scanning lines are grouped for each predetermined number to form blocks and the pixels disposed in rows and columns are sequentially driven in a unit of a block and line-sequential driving wherein the scanning lines are scanned in each of the blocks to sequentially drive the pixels in a unit of a row.

14 Claims, 35 Drawing Sheets

(56) References Cited

FOREIGN PATENT DOCUMENTS

| | | | |
|---|---|---|---|
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2006-195477 | A | 7/2006 |
| JP | 2006-330140 | A | 12/2006 |
| JP | 2007-148129 | A | 6/2007 |
| JP | 2007-155754 | A | 6/2007 |
| JP | 2007-225898 | A | 9/2007 |
| JP | 2007-279738 | A | 10/2007 |

* cited by examiner (1)

(2), (3)

(4)

(5)

(5a)

(6)

(7)

DISPLAY APPARATUS, DRIVING METHOD FOR DISPLAY APPARATUS AND ELECTRONIC APPARATUS

CROSS REFERENCES TO RELATED APPLICATIONS

The present invention contains subject matter related to Japanese Patent Application JP 2007-259166, filed in the Japan Patent Office on Oct. 6, 2008, the entire contents of which being incorporated herein by reference.

BACKGROUND OF THE INVENTION

1. Field of the Invention

This invention relates to a display apparatus of the active matrix type wherein a light emitting element is used in a pixel and a driving method for a display apparatus of the type described. The present invention relates also to an electronic apparatus which includes a display apparatus of the type described.

2. Description of the Related Art

In recent years, development of a display apparatus of the planar self-luminous type which uses an organic EL (electroluminescence) device as a light emitting element is proceeding energetically. The organic EL device utilizes a phenomenon that, if an electric field is applied to an organic thin film, then the organic thin film emits light. Since the organic EL device is driven by an application voltage lower than 10V, the power consumption of the same is low. Further, since the organic EL device is a self-luminous device which itself emits light, it requires no illuminating member and can be formed as a device of a reduced weight and a reduced thickness. Further, since the response speed of the organic EL device is approximately several μs and very high, an after-image upon display of a dynamic picture does not appear.

Among display apparatus of the flat self-luminous type wherein an organic EL device is used in a pixel, a display apparatus of the active matrix type wherein thin film transistors as active elements are formed in an integrated relationship in pixels is being developed energetically. A flat self-luminous display apparatus of the active matrix type is disclosed, for example, in Japanese Patent Laid-Open Nos. 2003-255856 (hereinafter referred to as Patent Document 1), 2003-271095 (hereinafter referred to as Patent Document 2), 2004-133240 (hereinafter referred to as Patent Document 3), 2004-029791 (hereinafter referred to as Patent Document 4) and 2004-093682 (hereinafter referred to as Patent Document 5).

FIG. 23 schematically shows an example of an existing active matrix display apparatus. Referring to FIG. 23, the display apparatus shown includes a pixel array section 1 and peripheral driving sections. The driving sections include a horizontal selector 3 and a write scanner 4. The pixel array section 1 includes a plurality of signal lines SL extending along the direction of a column and a plurality of scanning lines WS extending along the direction of a row. A pixel 2 is disposed at a place at which each of the signal lines SL and each of the scanning lines WS intersect with each other. In order to facilitate understandings, only one pixel 2 is shown in FIG. 23. The write scanner 4 includes a shift register which operates in response to a clock signal ck supplied thereto from the outside to successively transfer a start pulse sp supplied thereto similarly from the outside to output a sequential control signal to the scanning line WS. The horizontal selector 3 supplies an image signal to the signal line SL in synchronism with the line sequential scanning of the write scanner 4 side.

The pixel 2 includes a sampling transistor T1, a driving transistor T2, a storage capacitor C1 and a light emitting element EL (electroluminescence). The driving transistor T2 is of the P-channel type, and is connected at the source thereof, which is one of current terminals, to a power supply line and at the drain thereof, which is the other current terminal, to the light emitting element EL. The driving transistor T2 is connected at the gate thereof, which is a control terminal thereof, to the signal line SL through the sampling transistor T1. The sampling transistor T1 is rendered conducting in response to a control signal supplied thereto from the write scanner 4 and samples and writes an image signal supplied from the signal line SL into the storage capacitor C1. The driving transistor T2 receives, at the gate thereof, the image signal written in the storage capacitor C1 as a gate voltage Vgs and supplies drain current Ids to the light emitting element EL. Consequently, the light emitting element EL emits light with luminance corresponding to the image signal. The gate voltage Vgs represents a potential at the gate with reference to the source.

The driving transistor T2 operates in a saturation region, and the relationship between the gate voltage Vgs and the drain current Ids is represented by the following characteristic expression:

$$Ids=(1/2)\mu(W/L)Cox(Vgs-Vth)^2$$

where μ is the mobility of the driving transistor, W the channel width of the driving transistor, L the channel length of the driving transistor, Cox the gate insulating layer capacitance per unit area of the driving transistor, and Vth is the threshold voltage of the driving transistor. As can be apparently seen from the characteristic expression, when the driving transistor T2 operates in a saturation region, it functions as a constant current source which supplies the drain current Ids in response to the gate voltage Vgs.

FIG. 24 illustrates a voltage/current characteristic of the light emitting element EL. In FIG. 24, the axis of abscissa indicates the anode voltage V and the axis of ordinate indicates the drain current Ids. It is to be noted that the anode voltage of the light emitting element EL is the drain voltage of the driving transistor T2. The current/voltage characteristic of the light emitting element EL varies with time such that the characteristic curve thereof tends to become less steep as time passes. Therefore, even if the drain current Ids is fixed, the anode voltage or drain voltage V varies. In this regard, since the driving transistor T2 in the pixel 2 shown in FIG. 23 operates in a saturation region and can supply drain current Ids corresponding to the gate voltage Vgs irrespective of the variation of the drain voltage, the emission light luminance can be kept fixed irrespective of the time variation of the characteristic of the light emitting element EL.

FIG. 25 shows another example of an existing pixel circuit. Referring to FIG. 25, the pixel circuit shown is different from that described hereinabove with reference to FIG. 23 in that the driving transistor T2 is not of the P-channel type but of the N-channel type. From a fabrication process of a circuit, it is frequently advantageous to form all transistors which compose a pixel from N-channel transistors.

SUMMARY OF THE INVENTION

Increase of the definition and the size of a display panel has proceeded until the number of scanning lines exceeds 1,000. Also the size of a light scanner for scanning a large number of scanning lines line-sequentially has increased. In recent years, together with increase of the size of a display panel and a driving section, block driving has been developed. In this instance, the driving section of the display apparatus groups the scanning lines for each predetermined number to form blocks, and uses block-sequential driving of successively driving pixels arrayed in rows and columns in a unit of a block and line-sequential driving of driving the scanning lines in each block to successively drive the pixels in a unit of a row to display an image on the panel.

Existing block driving has a problem in that, between pixel rows positioned on the boundary between adjacent blocks, a difference in luminance is caused by a difference in operation condition and damages the uniformity of the screen image. The last pixel row of a preceding one of a pair of preceding and succeeding blocks is line-sequentially scanned last in the block. On the other hand, the first pixel row of the succeeding block is line-sequentially scanned first in the block. Although the last row pixels of the preceding block and the top row pixels of the succeeding block are positioned adjacent each other, from the driving condition, the order in line sequential scanning is the last and the first, respectively, and the driving conditions in time are extremely different from each other. This appears as a delicate difference in luminance between the two pixel rows and makes a cause of deterioration of the uniformity of the screen image.

Therefore, it is desirable to provide a display apparatus of the block driving type which is improved in uniformity of the display image thereof.

According to the present invention, there is provided a display apparatus including a pixel array section including a plurality of scanning lines disposed in rows, a plurality of signal lines disposed in columns, and a plurality of pixels arranged in rows and columns at places at which the scanning lines and the signal lines intersect with each other, and a driving section configured to drive the pixels through the scanning lines and the signal lines, the driving section carrying out block-sequential driving wherein the scanning lines are grouped for each predetermined number to form blocks and the pixels disposed in rows and columns are sequentially driven in a unit of a block and line-sequential driving wherein the scanning lines are scanned in each of the blocks to sequentially drive the pixels in a unit of a row, the driving section carrying out the block-sequential driving and the line-sequential driving such that the scanning direction of the line-sequential driving is reversed between each adjacent ones of the blocks.

According to an embodiment of the present invention, the display apparatus is configured such that the driving section includes a signal selector configured to supply an image signal having a signal potential corresponding to a gradation and a predetermined reference potential to the signal lines disposed in columns, a write scanner configured to supply a sequential control signal to the scanning lines disposed in rows, and a drive scanner configured to supply a power supply voltage which changes over between a high potential and a low potential to a plurality of feed lines disposed in parallel to the scanning lines, each of the pixels including a sampling transistor connected at a first one of a pair of current terminals thereof to one of the signal lines and at a control terminal thereof to one of the scanning lines, a driving transistor connected at a first one of a pair of current terminals thereof, which becomes the drain side, connected to one of the feed lines and at a control terminal thereof, which becomes a gate, to a second one of the current terminals of the sampling transistor, a light emitting element connected to a second one of the current terminals of the driving transistor which becomes the source side, and a storage capacitor connected between the source and the gate of the driving transistor, the drive scanner grouping the feed lines disposed in rows for each predetermined number to form blocks such that the power supply voltage is changed over between the high potential and the low potential with the phase thereof displaced in order to carry out block-sequential driving in a unit of a block and the potential of the predetermined number of feed lines in each block is changed over in the same phase, the write scanner carrying out the line-sequential scanning of sequentially supplying the control signal to the scanning lines in each block for each horizontal period such that the scanning direction of the line-sequential driving is reversed between each adjacent ones of the blocks.

Preferably, the display apparatus is configured such that the power supply scanner carries out, in the block-sequential driving, a correction preparation operation of changing over the potential of the feed lines all at once from the high potential to the low potential to lower the source voltage of the driving transistors and then returning the potential of the feed lines all at once from the low potential to the high potential, and the write scanner carries out, in the line-sequential driving, a correction operation of supplying, when the pertaining signal line has the reference potential, the control signal to the scanning lines to turn on the sampling transistors to raise the source voltage of the driving transistors and discharging the storage capacitors so that the voltage between the gate and the source of the driving transistors varies toward a threshold voltage of the driving transistors.

Or, the display apparatus may be configured such that the light scanner carries out, in the line-sequential driving, a writing operation of supplying, when the pertaining signal line has the signal potential, the control signal to the scanning lines and turning on the sampling transistors to write the signal potential into the storage capacitors, and the signal selector reverses the order of the signal potential to be supplied to the signal lines between each adjacent ones of the blocks.

The power supply scanner may include a plurality of gate drivers individually corresponding to the blocks.

According to another embodiment of the present invention, the display apparatus is configured such that each of the pixels includes a sampling transistor, a driving transistor, a storage capacitor and a light emitting element, the sampling transistor being connected at a control terminal thereof to an associated one of the scanning lines and at a pair of current terminals thereof to a first one of the signal lines and a control terminal of the driving transistor, the driving transistor being connected at a first one of a pair of current terminals thereof to the light emitting element and at a second one of the current terminals thereof to a power supply, the storage capacitor being connected between the control terminal and one of the current terminals of the driving transistor, the driving section including a write scanner for supplying control signals to the scanning lines and a signal selector for switchably supplying a signal potential and a reference potential to the signal lines, the sampling transistor carrying out a threshold voltage correction operation in response to a control signal supplied to the associated scanning line when the associated signal line has the reference potential to write a voltage corresponding to a threshold voltage of the driving transistor into the storage capacitor and then a signal potential writing operation in response to a control signal supplied to the associated scanning line when the associated signal line has the signal potential to sample an image signal from the associated signal line and write the sampled image signal to the storage capacitor, the driving transistor supplying current in response to the signal potential written in the storage capacitor to the light emitting element to cause the light emitting element to emit light, the scanning lines of the pixel array section being divided for each predetermined number thereof into blocks while scanning periods individually allocated to the predetermined number of signal lines for each of the blocks are combined to form a composite period including a first period and a second period, the write scanner selecting the blocks individually for sequential composite periods to scan the pixel array section, the write scanner supplying, within the first period of each composite period, control signals all at once to the predetermined number of scanning lines which belong to one of the blocks to execute a threshold voltage correction operation in a unit of a block, the write scanner outputting, within the second period of each composite period, sequential control signals to the predetermined number of scanning lines which belong to one of the blocks to carry out line sequential scanning thereby to execute a sequential signal potential writing operation in a unit of a row, the write scanner outputting the sequential control signals such that the line sequential scanning of the scanning lines is carried out in the reverse directions to each other between adjacent ones of the blocks.

Preferably, the write scanner is composed of a plurality of gate drivers individually corresponding to the blocks.

Preferably, the time after the threshold voltage correction operation is completed until the signal writing operation is entered is equal between those pixels which belong to rows adjacent each other between adjacent ones of the blocks.

In the display apparatus, the scanning direction of the line-sequential driving is controlled so as to be reversed between each adjacent ones of the blocks. Consequently, the difference in operation condition is minimized between pixel rows positioned on the boundary between adjacent blocks, and no difference in luminance appears on the boundary. Therefore, the uniformity of the screen image of the display apparatus can be improved. The last pixel row of a preceding one of a pair of preceding and succeeding blocks is line-sequentially scanned last in the block whereas also the first pixel row in the succeeding block is line-sequentially scanned last in the block. This is because the scanning direction of the line-sequential driving is controlled so as to be reversed between adjacent blocks. Both of the last pixel row of the preceding block and the top pixel row of the succeeding block which are adjacent each other are line-sequentially scanned last in the individual blocks and are driven in the same driving condition in time. Consequently, no difference in luminance appears between the two pixel rows, and the uniformity of the screen image can be improved.

DETAILED DESCRIPTION OF THE PREFERRED EMBODIMENT

Figure 1:
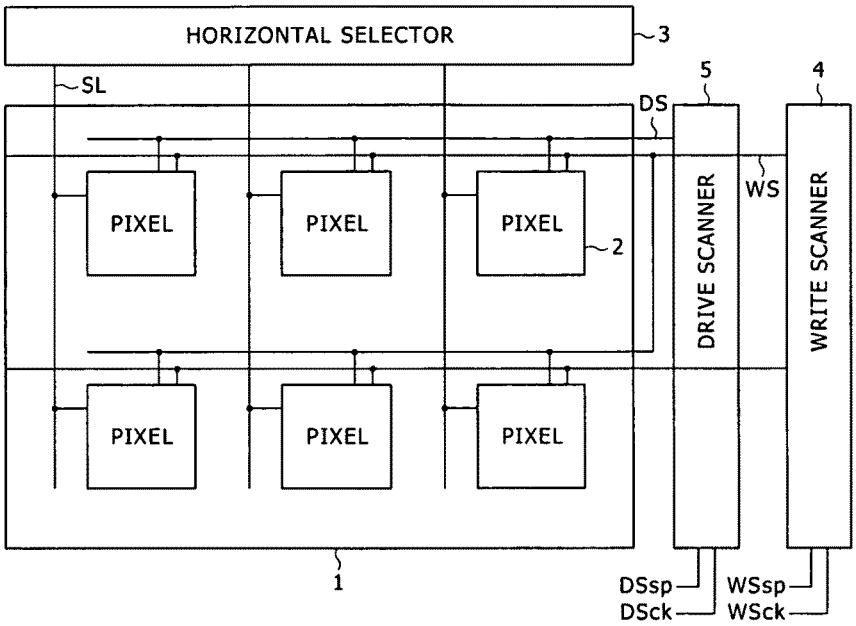
FIG. 1 is a block diagram showing a general configuration of a display apparatus according to a first embodiment of the present invention.

The preferred embodiment of the present invention will now be described in reference to the accompanying drawings. In the FIG. 1, there is shown a general configuration of a display apparatus according to the present invention. The display apparatus shown includes a pixel array section 1, and driving sections (3, 4 and 5) for driving the pixel array section 1. The pixel array section 1 includes a plurality of scanning lines WS extending along the direction of a row, a plurality of signal lines SL extending along the direction of a column, a plurality of pixels 2 disposed in rows and columns at places at which the scanning lines WS and the signal lines SL intersect with each other, and a plurality of feed lines DS serving as power supply lines disposed corresponding to the rows of the pixels 2. The driving sections 3, 4 and 5 include a controlling scanner (write scanner) 4 for successively supplying a control signal to the scanning lines WS to line-sequentially scan the pixels 2 in a unit of a row, a power supply scanner (drive scanner) 5 for supplying a power supply potential which is changed over between a high potential and a low potential to each of the feed lines DS in response to the line-sequential scanning, and a signal driver (horizontal selector) 3 for supplying a signal potential serving as an image signal and a reference potential to the signal lines SL in the columns in response to the line-sequential scanning. It is to be noted that the controlling scanner or write scanner 4 operates in response to a clock signal WSck supplied thereto from the outside to successively transfer a start pulse WSsp supplied similarly from the outside to output a control signal to the scanning lines WS. The power supply scanner or drive scanner 5 operates in response to a clock signal DSck supplied from the outside to successively transfer a start pulse DSsp supplied similarly from the outside to line-sequentially change over the potential of the feed lines DS.

In the present first embodiment, the drive scanner 5 groups the feed lines DS of the rows for each predetermined number to form blocks and carries out changeover between a high potential Vcc and a low potential Vss with the phase successively displaced in a unit of a block while the potential of the predetermined number of feed lines DS is changed over in the same phase in each block. In the example shown, the drive scanner 5 groups the feed lines DS of the rows for each two to form blocks and carries out changeover between the high potential and the low potential with the phase successively displaced in a unit of a block and besides changes over the potential of the two feed lines DS in each block in the same phase. It is to be noted, however, that, according to the present invention, the number of feed lines DS to form a block is not limited to two, but generally a common driving timing is applied to feed lines DS of a plurality of rows or stages of one block.

The drive scanner 5 is basically formed from a shift register and output buffers connected to individual shift stages of the shift register. The shift register operates with a clock signal DSck supplied thereto from the outside and successively transfers a start signal DSsp supplied thereto from the outside similarly to output a control signal to be used for power supply changeover for each shift stage. Each of the output buffers changes over a power supply between the high potential and the low potential and outputs the potential to a feed line DS. In the present invention, a common control timing is applied to a plurality of power supply lines to commonly use an output buffer among a plurality of power supply lines. Consequently, the number of output buffers can be reduced. Since the output buffers supply power to the feed lines DS, a high current driving capacity is required for the output buffers, and they have a great device size. By decreasing the number of output buffers having the great device size, reduction of the circuit size, reduction of the cost and increase of the yield of the peripheral driving sections can be achieved. For example, if one output buffer is commonly applied to two feed lines DS as in the example of FIG. 1, then the number of output buffers can be reduced to one half comparing to that of the first embodiment. On the other hand, if a common control timing is applied to 10 feed lines DS, then the number of output buffers can be reduced to one tenth.

Figure 2:
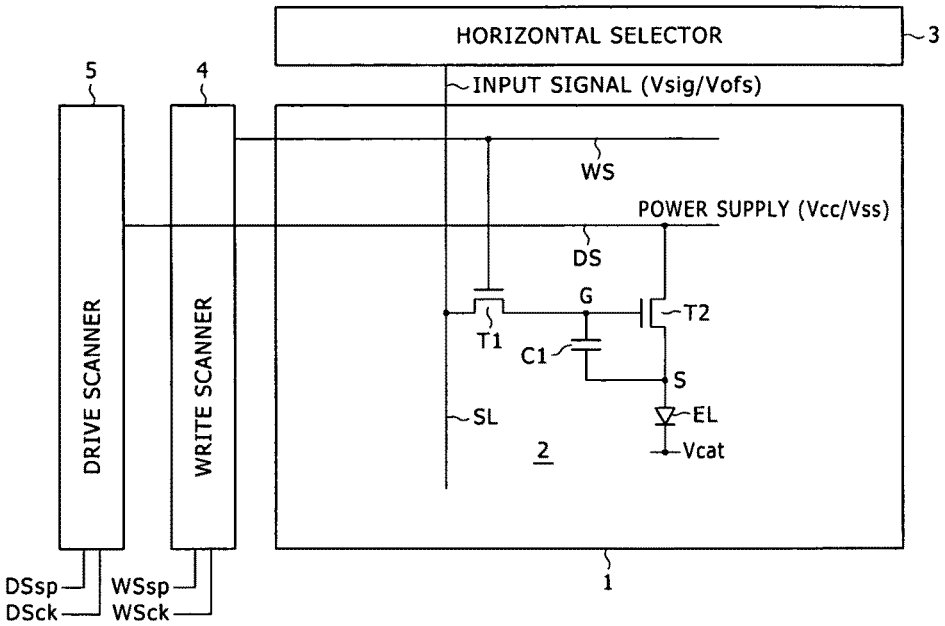
FIG. 2 is a circuit diagram showing a circuit configuration of the display apparatus shown in FIG. 1.

FIG. 2 shows a particular configuration of the pixels 2 included in the display apparatus shown in FIG. 1. Referring to FIG. 2, each pixel 2 includes a light emitting element EL of the two-terminal type or diode type represented by an organic EL device, a sampling transistor T1 of the N-channel type, a driving transistor T2 of the N-channel type, and a storage capacitor C1 of the thin film type. The sampling transistor T1 is connected at the gate thereof, which serves as a control terminal, to a scanning line WS, at one of the source and the drain thereof, which serve as current terminals, to the gate G of the driving transistor T2, and at the other one of the source and the drain thereof to a signal line SL. The driving transistor T2 is connected at one of the source and the drain thereof to the light emitting element EL and at the other one of the source and the drain thereof to a feed line DS. In the present embodiment, the driving transistor T2 is of the N-channel type and is connected at the drain side thereof, which is one of the current terminals, to the feed line DS and at the source S side thereof, which is the other current terminal, to the anode side of the light emitting element EL. The light emitting element EL is connected at the cathode thereof and fixed to a predetermined cathode potential Vcat. The storage capacitor C1 is connected between the source S as the current terminal and the gate G as the control terminal of the driving transistor T2. The controlling scanner or write scanner 4 changes over the potential to the scanning line WS between the low potential and the high potential to output a sequential control signal to the pixels 2 having such a configuration as described above thereby to line-sequentially scan the pixels 2 in a unit of a row. The power supply scanner or driver scanner 5 supplies a power supply potential, which changes over between a high potential Vcc and a low potential Vss to the feed lines DS in response to the line-sequential scanning. The signal selector or horizontal selector 3 supplies a signal potential Vsig, which is an image signal, and a reference potential Vofs to the signal lines SL extending in the column direction in synchronism with the line-sequential scanning.

In the pixel having the configuration described above, when the feed line DS has the high potential Vcc and the signal line SL has the reference potential Vofs, if the sampling transistor T1 is placed into an on state in accordance with the control signal, then a turning off operation of changing over the light emitting element EL from a turned on state into a turned off state is carried out. Then, the potential of the feed line DS is changed over from the high potential Vcc to the low potential Vss and, while the feed line DS has the low potential Vss, the source voltage of the driving transistor T2 is lowered without turning on the sampling transistor T1 to carry out a preparation operation for setting the gate-source voltage Vgs to a voltage higher than the threshold voltage Vth of the driving transistor T2. Thereafter, the potential of the feed line DS is returned to the high potential Vcc from the low potential Vss, and when the signal line SL has the reference potential Vofs, the sampling transistor T1 is turned on in accordance with the control signal to raise the source voltage of the driving transistor T2 thereby to carry out a correction operation of discharging the storage capacitor C1 so that the gate-source voltage Vgs varies toward the threshold voltage Vth.

According to the present invention, at first, when the feed line DS has the high potential Vcc and the signal line SL has the reference potential Vofs, a turning off operation of changing over the state of the light emitting element EL from a turned on state to a turned off state is carried out. Then, the potential of the feed line DS is changed over to the low potential Vss and, while the feed line DS has the low potential Vss, the preparation operation for setting the gate-source voltage Vgs of the driving transistor T2 to a voltage higher than the threshold voltage Vth is carried out without turning on the sampling transistor T1. Thereafter, the feed line DS is returned from the low potential Vss to the high potential Vcc, and when the signal line SL has the reference potential Vofs, the sampling transistor T1 is turned on to carry out a correction operation for discharging the storage capacitor C1 so that the gate-source voltage Vgs of the driving transistor T2 varies toward the threshold voltage Vth. By carrying out the turning off operation, preparation operation and correction operation in this manner, a malfunction can be prevented thereby to carry out threshold value correction of the driving transistor T2 stably and with certainty. Particularly in the preparation operation, since the source voltage of the driving transistor T2 is lowered without turning on the sampling transistor T1, a malfunction of the pixel 2 is prevented and the correction operation is stabilized.

Figure 3A:
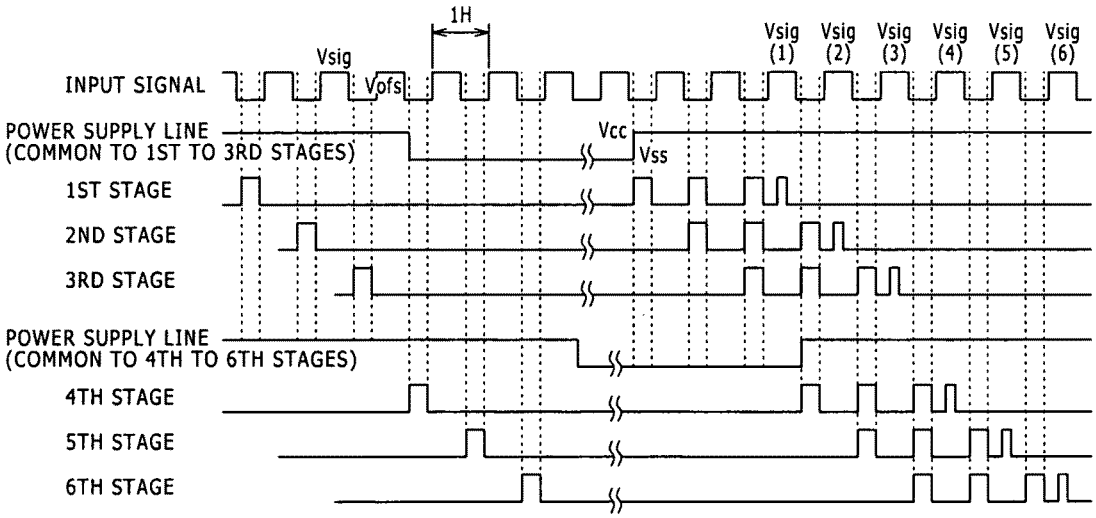
FIGS. 3A and 3B are reference timing charts illustrating different operations of the display apparatus shown in FIG. 1.

FIG. 3A illustrates operation of the display apparatus shown in FIG. 2. It is to be noted that the timing chart of FIG. 3A illustrates operation where power supply lines for three stages are controlled with a common timing. More particularly, FIG. 3A indicates an image signal as an input signal supplied to a signal line, potential variations of feed lines or power supply lines each three ones of which form a block, and control signals or control pulses applied to scanning lines of the individual rows or stages. First, the input signal exhibits the signal potential Vsig and the reference potential Vofs changed over alternately within one horizontal period (1H). The power supply lines for the first to third stages have a common potential variation such that the potential changes over from the high potential to the low potential and then returns to the high potential simultaneously among the power supply lines for the first to third stages. Meanwhile, to the scanning line for the first stage, a first control pulse is outputted when the input signal is the reference potential Vofs and the power supply line has the high potential Vcc, and the pixels of the corresponding row are changed over from a turned on state to a turned off state. Thereafter, second to fourth control pulses are generated successively, and the threshold voltage correction operation is repeated three times. Finally, a fifth control pulse is generated, and writing of the signal potential Vsig and mobility correction are carried out.

To the scanning line for the second stage, first to fifth control pulses having a phase shifted by 1H from that of the pulses for the first stage are successively outputted, and a turning off operation, a threshold voltage correction operation and a signal potential writing operation are carried out similarly to those for the first stage. Also for the third stage, first to fifth control pulses having a phase shifted by 1H from that of the pulses for the second stage are successively outputted, and a turning off operation, a threshold voltage correction operation and a signal potential writing operation are carried out similarly.

When the operation sequence advances to the fourth to sixth stages, the drive scanner changes over the common potential to the power supply lines for the fourth to sixth stages once from the high potential Vcc to the low potential Vss and then back to the high potential Vcc. In this manner, the drive scanner carries out the potential changeover of the fourth to sixth power supply lines with the phase displaced from that for the first to third stages. In a corresponding relationship, five control pulses are successively applied to each of the scanning lines for the fourth to sixth stages, and operations similar to those in the first to third stages are repeated.

As apparent from the foregoing description, in the operation illustrated in FIG. 3A, the potential to power supply lines for three stages is controlled at common timings. By such potential control, the number of outputs of the drive scanner can be reduced, and particularly in the example of FIG. 3A, the number can be reduced to one third. Consequently, reduction in cost can be anticipated.

It is to be noted that, in the example of FIG. 3A, the period of time after the potential of a power supply line is changed back from the low potential Vss to the high potential Vcc until the first time threshold voltage correction operation is started is different among the first, second and third stages. As described hereinabove, when the potential of a power supply line is changed back from the high potential Vcc to the low potential Vss, if the current flowing to the driving transistor is low, that is, if the gate-source voltage Vgs of the driving transistor is low, then the gate voltage and the source voltage little rise. Therefore, in all stages, the threshold voltage correction operation can be carried out regularly.

Figure 3B:
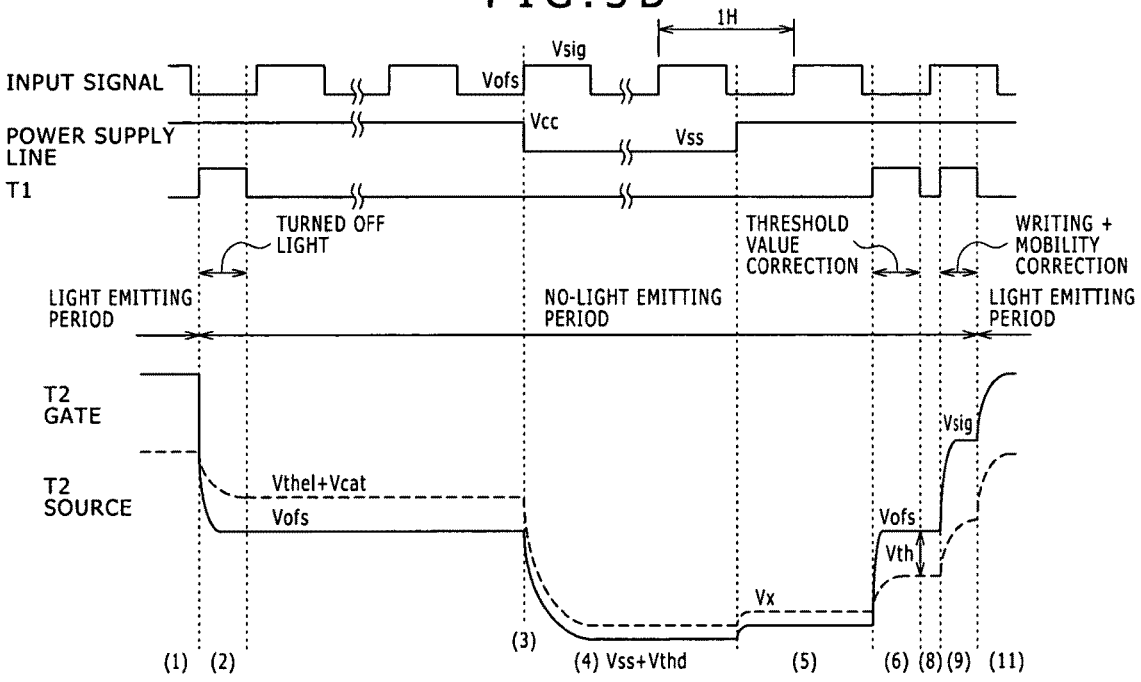

FIG. 3B illustrate operation of the pixel shown in FIG. 2. It is to be noted that the operation illustrated in FIG. 3 is a reference example, and the operation of the pixel circuit shown in FIG. 2 is not limited to that illustrated in FIG. 3B. The timing chart of FIG. 3B illustrates the potential variation of the scanning line WS, the potential variation of the feed line or power supply line DS and the potential variation of the signal line SL with respect to the common time axis. The potential variation of the scanning line WS represents the control signal and controls the sampling transistor T1 between open and closed state. The potential variation of the feed line DS represents changeover between the power supply voltages Vcc and Vss. The potential variation of the signal line SL represents changeover between the signal potential Vsig and the reference potential Vofs of the input signal. In parallel to the potential variations mentioned, also the potential variations of the gate G and the source S of the driving transistor T2 are illustrated. The potential difference Vgs is the potential difference between the gate G and the source S as described hereinabove.

In the timing chart of FIG. 3B, the period illustrated is divided into divisional periods (1) to (11) in accordance with the operation sequence of the pixel for the convenience of illustration and description. Within the turned-on period (1), the pixel is in a light emitting state. When the turned-off period (2) is entered, the pixel changes over from the light emitting state to a no-light emitting state. Then, within the preparation period (3) to (5), the pixel carries out a preparation operation for threshold voltage correction of the driving transistor. Thereafter, within the correction period (6), an actual threshold voltage correction operation is carried out. Normally, the correction period (6) is repeated by a plural number of times with the waiting period (8) interposed therebetween to complete the threshold voltage correction operation. Thereafter, within the writing period (9), a signal potential is written into the storage capacitor C1 and mobility correction of the sampling transistor T1 is carried out. Finally, the light emitting period (11) is entered, within which the pixel is changed over from the no-light emitting state to the light emitting state. It is to be noted that, in FIG. 3B, it is illustrated that the correction operation is carried out once within the single threshold value correction period (6) for simplified illustration.

Thereafter, the writing operation period/mobility correction period (9) is entered. Here, the signal potential Vsig of the image signal is written in an accumulated manner into the storage capacitor C1 while a voltage ΔV for mobility correction is subtracted from the voltage stored in the storage capacitor C1. Within the writing operation period/mobility correction period (9), it is necessary to place the sampling transistor T1 into a conducting state within a time zone within which the signal line SL remains having the signal potential Vsig. Thereafter, the light emitting period (11) is entered, and the light emitting element emits light with a luminance corresponding to the signal potential Vsig. Thereupon, since the signal potential Vsig is adjusted with the voltage corresponding to the threshold voltage Vth and the voltage ΔV for mobility correction, the emission light luminance of the light emitting element EL is not influenced by the dispersion of the threshold voltage Vth or the mobility μ of the driving transistor T2. It is to be noted that a bootstrap operation is carried out at the beginning of the light emitting period (11), and while the gate-source voltage Vgs of the driving transistor T2 is kept fixed, the gate potential and the source potential of the driving transistor T2 rise.

Figure 4A:
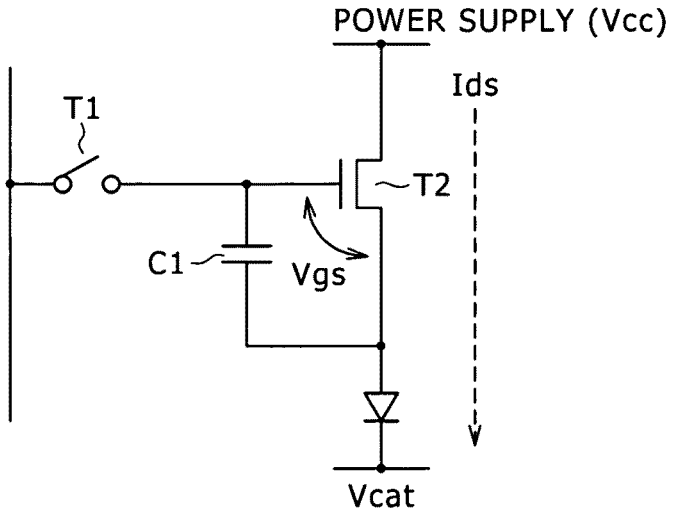
FIGS. 4A to 4F are circuit diagrams illustrating operations of the display apparatus shown in FIG. 1.

Operation of the pixel circuit shown in FIG. 2 is described in detail with reference to FIGS. 4A to 4K. First, within the light emitting period (1) of the light emitting element EL, as seen in FIG. 4A, the power supply is the first potential Vcc and the sampling transistor T1 is in an off state. At this time, since the driving transistor T2 is set so as to operate in a saturation region, the driving current Ids flowing through the light emitting element EL assumes a value given by the characteristic expression (1) given hereinabove in response to the gate-source voltage Vgs of the driving transistor T2.

Figure 4B:
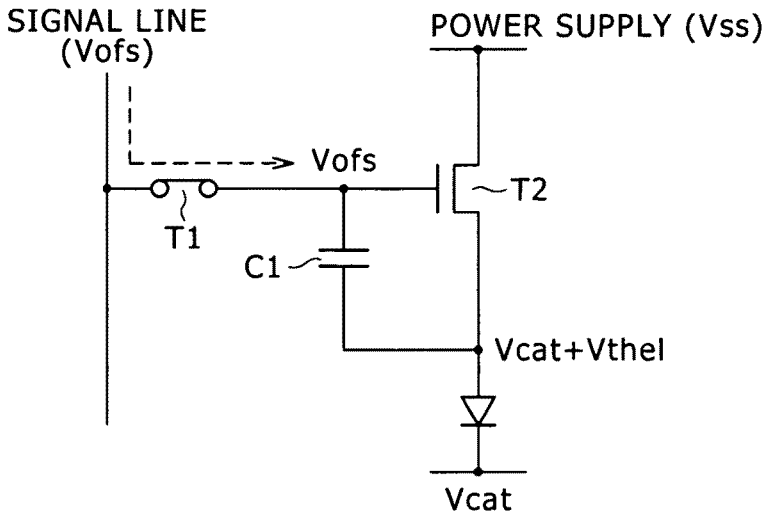

Then, within the turned-off period (2), when the signal line potential is the reference potential Vofs, the sampling transistor T1 is turned on to input the reference potential Vofs to the gate of the driving transistor T2 as seen in FIG. 4B. Consequently, the gate-source voltage of the driving transistor T2 becomes lower than the threshold voltage and the current stops flowing through the light emitting element EL, and consequently, the light emitting element EL is turned off. At this time, since the voltage applied to the light emitting element EL is equal to the threshold voltage of the light emitting element EL, the anode potential of the light emitting element EL is the sum of the threshold voltage and the cathode voltage of the light emitting element EL, that is, Vcat+Vthel.

Figure 4C:
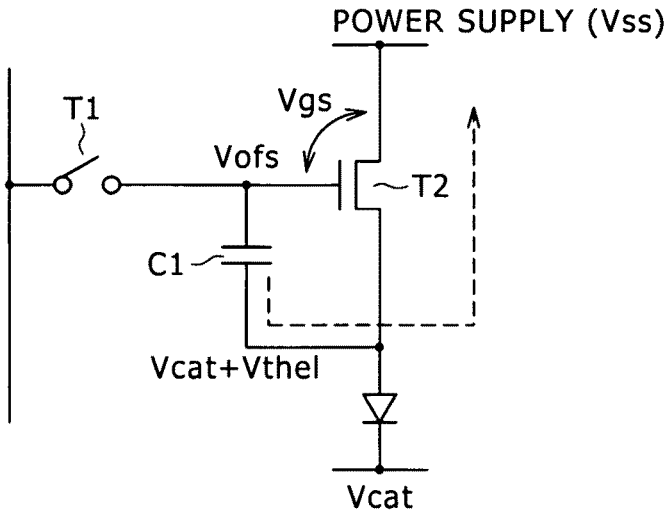

Further, after lapse of a fixed interval of time, the power supply voltage is varied from the high potential Vcc to the low potential Vss within the preparation period (3). At this time, the power supply side becomes the source of the driving transistor T2, and current flows from the anode of the light emitting element EL to the power supply as seen in FIG. 4C. Consequently, the voltage of the anode of the light emitting element EL gradually drops as time passes. At this time, since the sampling transistor T1 is in an off state, also the potential of the gate of the driving transistor T2 drops together with the anode voltage of the light emitting element EL. In other words, the gate-source voltage of the driving transistor T2, that is, the voltage between the gate of the driving transistor T2 and the power supply, decreases as time passes.

Figure 4D:
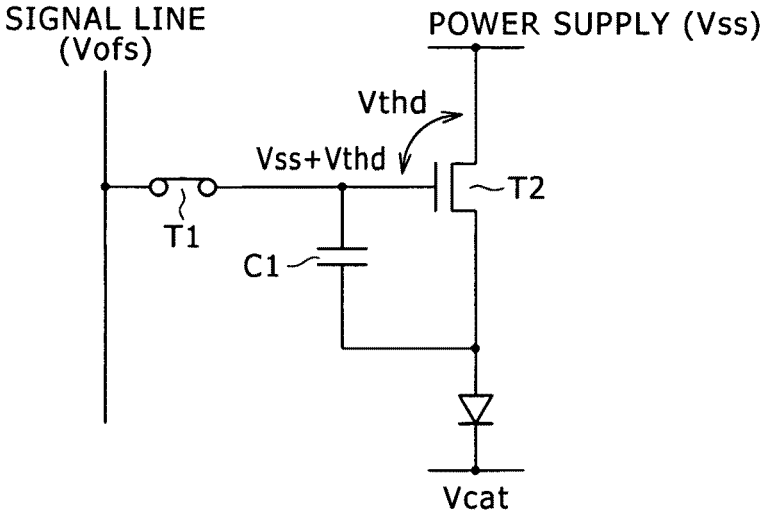

At this time, if the driving transistor T2 operates in the saturation region, that is, if Vgs−Vthd≤Vds, then the gate voltage of the driving transistor T2 is Vss+Vthd in the period (4) as seen in FIG. 4D. Here, Vthd represents the threshold voltage between the gate of the driving transistor T2 and the power supply.

Figure 4E:
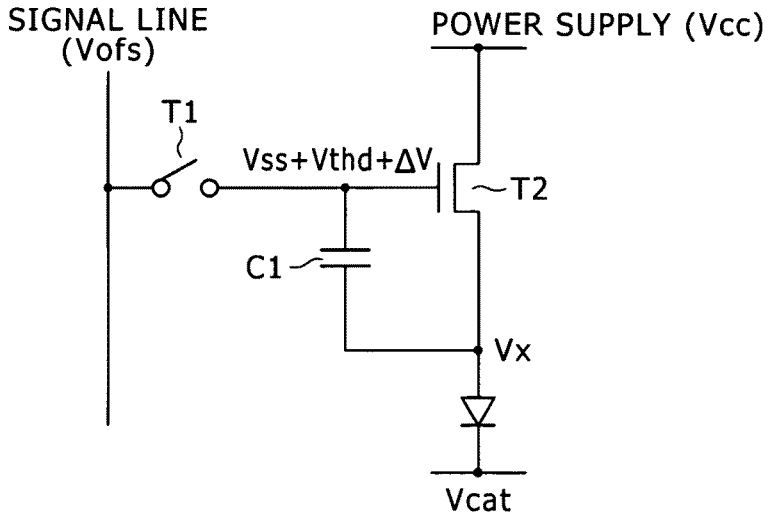

The power supply voltage is set to the high potential Vcc again within the period (5) as seen in FIG. 4E. At this time, the coupling amount inputted to the gate of the driving transistor T2 is ΔV and the anode voltage of the light emitting element EL is Vx. When the power supply is set to the high potential Vcc, the source of the driving transistor T2 becomes the anode of the light emitting element EL, and current flows from the power supply to the anode of the light emitting element EL due to the gate-source voltage Vgs of the driving transistor T2. However, if the gate-source voltage of the driving transistor T2 is lower than the threshold voltage, then the potentials at the gate and the source of the driving transistor T2 little rise regardless of the current.

Figure 4F:
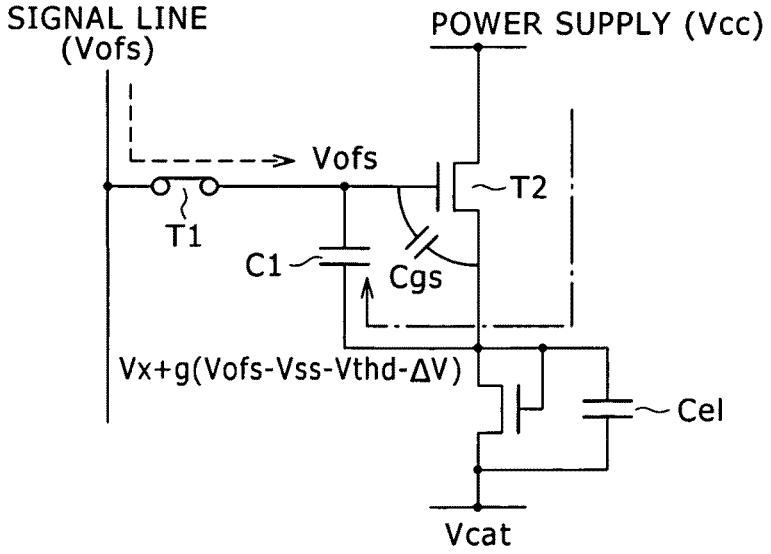

Then, within the threshold value correction period (6), when the signal voltage is the reference potential Vofs, the sampling transistor T1 is turned on as seen in FIG. 4F. Consequently, the gate voltage of the driving transistor T2 becomes the reference potential Vofs, and the variation amount of the gate voltage is inputted at a fixed ratio of the storage capacitor C1, the parasitic capacitance Cgs between the gate and the source and the parasitic capacitance Cel of the light emitting element EL to the source of the driving transistor T2. The input ratio in this instance is represented by g. Here, g is given by the following expression (2):

$$g=(C1+Cgs)/(C1+Cgs+Cel) \quad (2)$$

Figure 4G:
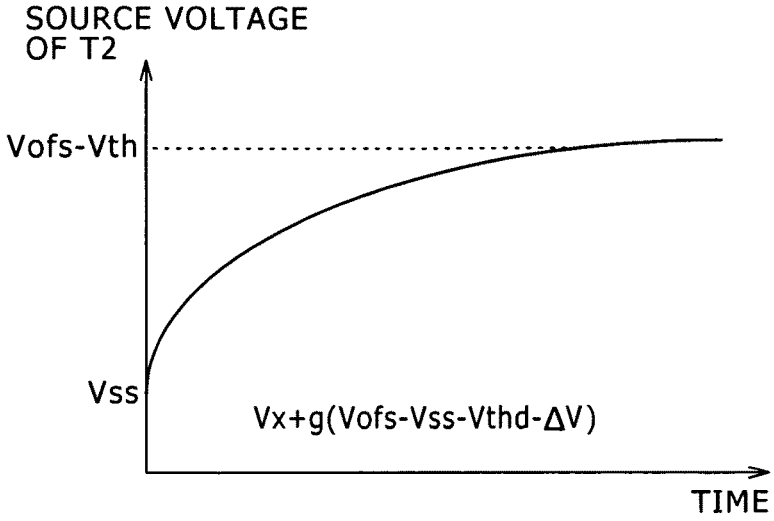
FIG. 4G is a graph illustrating operation of the display apparatus shown in FIG. 1.

In this state, if the gate-source voltage Vgs of the driving transistor T2 is higher than the threshold voltage Vth of the driving transistor T2, then current flows from the power supply as seen in FIG. 4F. In other words, it is necessary to set the values of the reference potential Vofs and the low potential Vss such that the gate-source voltage Vgs at this time is higher than the threshold voltage of the driving transistor T2. Since the equivalent circuit of the light emitting element EL described hereinabove is represented by a diode and a capacitor, the current of the driving transistor T2 is used to charge the storage capacitor C1 and the parasitic capacitance Cel as far as Vel≤Vcat+Vthel is satisfied (leak current of the light emitting element EL is considerably lower than current flowing through the driving transistor T2). At this time, the voltage Vel rises as time passes as seen in FIG. 4G.

Figure 4H:
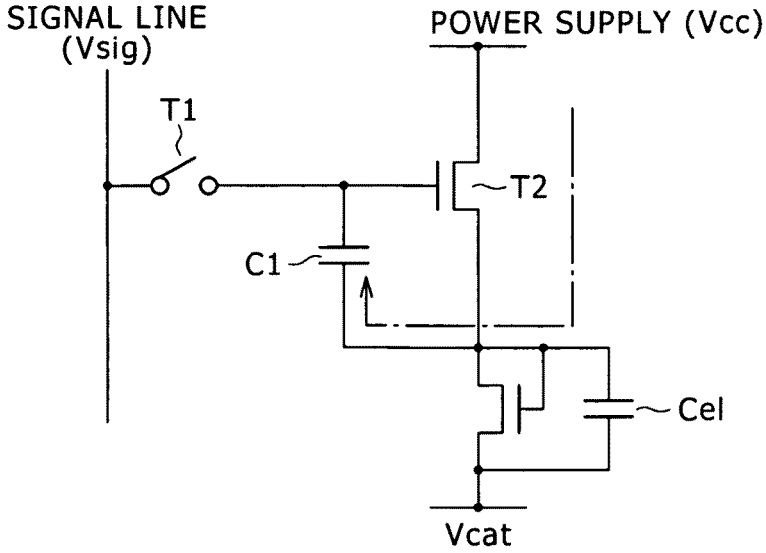
FIGS. 4H and 4I are circuit diagrams illustrating operations of the display apparatus shown in FIG. 1.

Within the next waiting period (8), the sampling transistor T1 is turned off before the signal voltage changes from the reference potential Vofs to the signal potential Vsig. At this time, since the gate-source voltage of the driving transistor T2 is higher than the threshold voltage Vth, current flows as seen in FIG. 4H, and the gate-source voltage of the driving transistor T2 gradually rises. At this time, since the light emitting element EL is in a reversely biased state, the light emitting element EL does not emit light.

Figure 4I:
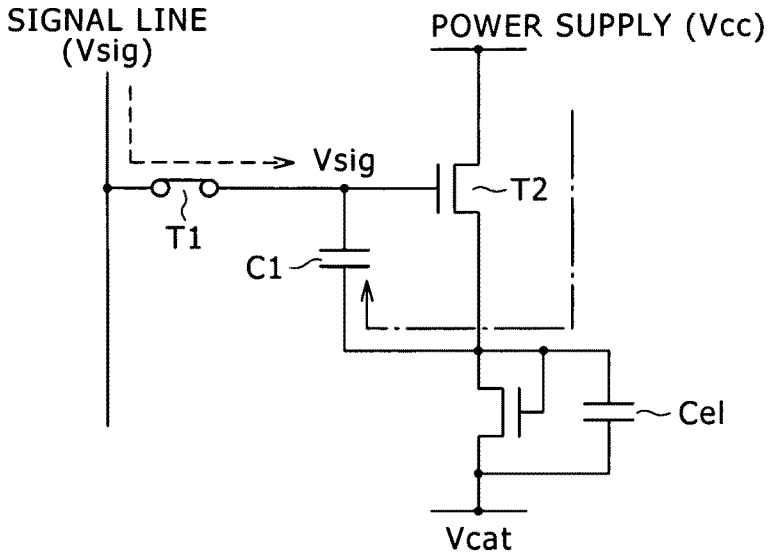
Figure 4J:
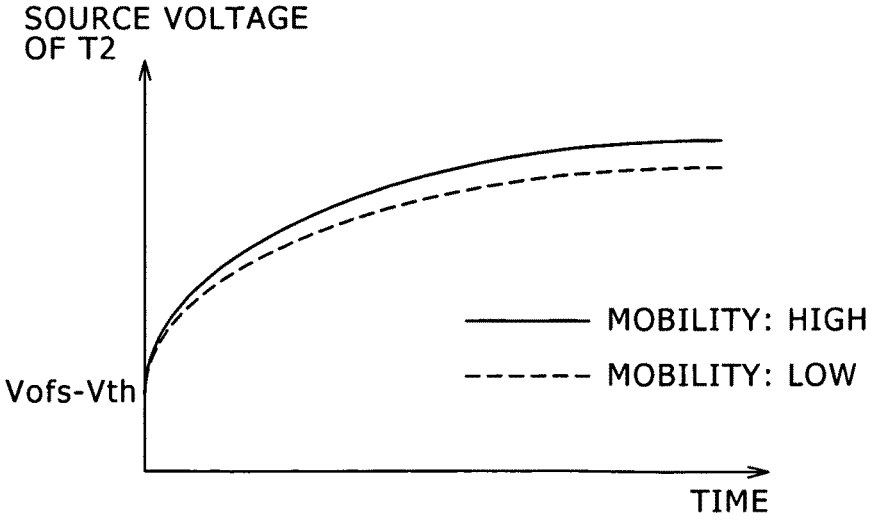
FIG. 4J is a graph illustrating operation of the display apparatus shown in FIG. 1.

After the threshold value cancellation operation comes to an end, the sampling transistor T1 is turned off. Then within the writing period (9), when the signal line potential becomes the signal potential Vsig, the sampling transistor T1 is turned on again as seen in FIG. 4I. The signal potential Vsig is a voltage corresponding to a gradation. Although the gate potential of the driving transistor T2 becomes the signal potential Vsig because the sampling transistor T1 is in an on state, since current flows from the power supply, the source potential of the driving transistor T2 gradually rises as time passes. At this time, if the source voltage of the driving transistor T2 does not exceed the sum of the threshold voltage Vthel and the cathode voltage Vcat of the light emitting element EL, that is, if the leak current of the light emitting element EL is considerably lower than the current flowing through the driving transistor T2, then the current of the driving transistor T2 is used to charge the storage capacitor C1 and the parasitic capacitance Cel. At this time, since the threshold value correction operation of the driving transistor T2 has been completed, the current supplied from the driving transistor T2 reflects the mobility μ. More particularly, where the mobility is high, also the current amount at this time is great and also the source potential rises quickly. On the contrary, where the mobility is low, the current amount is small and the source potential rises slowly as seen in FIG. 4J. Consequently, the gate-source voltage of the driving transistor T2 becomes lower reflecting the mobility, and after the fixed period of time passes, the gate-source voltage fully becomes the gate-source voltage Vgs which corrects the mobility.

Figure 4K:
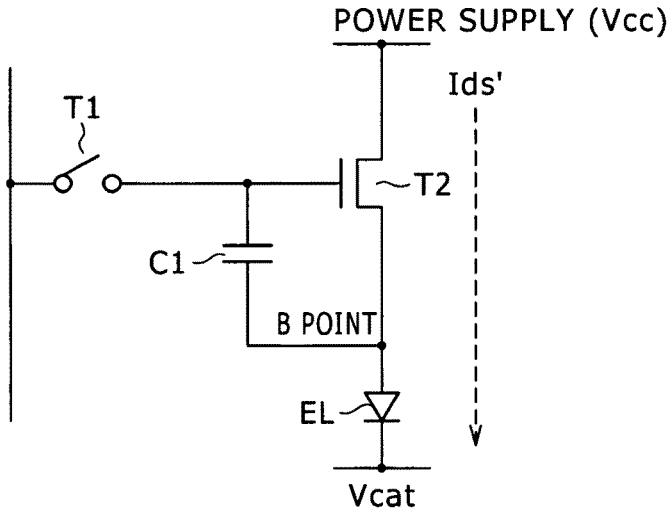
FIG. 4K is a circuit diagram illustrating operation of the display apparatus shown in FIG. 1.

Finally, when the sampling transistor T1 is turned off to end the writing and the light emitting period (11) is entered, the light emitting element EL is turned on to emit light. Since the gate-source voltage of the driving transistor T2 is fixed, the driving transistor T2 supplies fixed current Ids' to the light emitting element EL, and the voltage Vel rises to a voltage at which the fixed current Ids' flows through the light emitting element EL and the light emitting element EL emits light as seen in FIG. 4K.

Also in the present circuit, as the light emitting period becomes long, the I-V characteristic of the light emitting element EL varies. Therefore, also the potential at the point B in FIG. 4K varies. However, since the gate-source voltage of the driving transistor T2 is kept at a fixed value, the current flowing through the light emitting element EL does not vary. Therefore, even if the I-V characteristic of the light emitting element EL deteriorates, the fixed current Ids continues to flow and the luminance of the light emitting element EL does not vary.

Here, driving of the present pixel circuit is studied. While the present driving provides such driving timings as seen in FIG. 3A, the time after the power supply line is changed from the low potential Vss to the high potential Vcc until the threshold value correction operation is carried out is different among different lines whose timing is common. In particular, the period of time within which the power supply line has the potential Vcc before threshold value correction is carried out is longer at the N+1th stage than at the Nth stage. Consequently, the source potential of the driving transistor rises more in the N+1th stage than in the Nth stage due to the leak current of the driving transistor and the leak current of the light emitting element.

In particular, even if the source voltage of the driving transistor is different before the threshold value correction operation, if the gate-source voltage Vgs of the driving transistor is higher than the threshold voltage Vth of the driving transistor in the threshold correction operation, basically the threshold value correction operation can be carried out regularly. However, the luminance of the emitted light relies upon the source voltage of the driving transistor before the threshold value correction operation. Therefore, in the present driving, between the final stage in which the timing is common to power supply lines and a next stage, in FIG. 3A, between the third and fourth stages, the source voltage of the driving transistor when the threshold value correction is carried out varies suddenly whereas the source voltage varies moderately from the first to the third stages.

Figure 5:
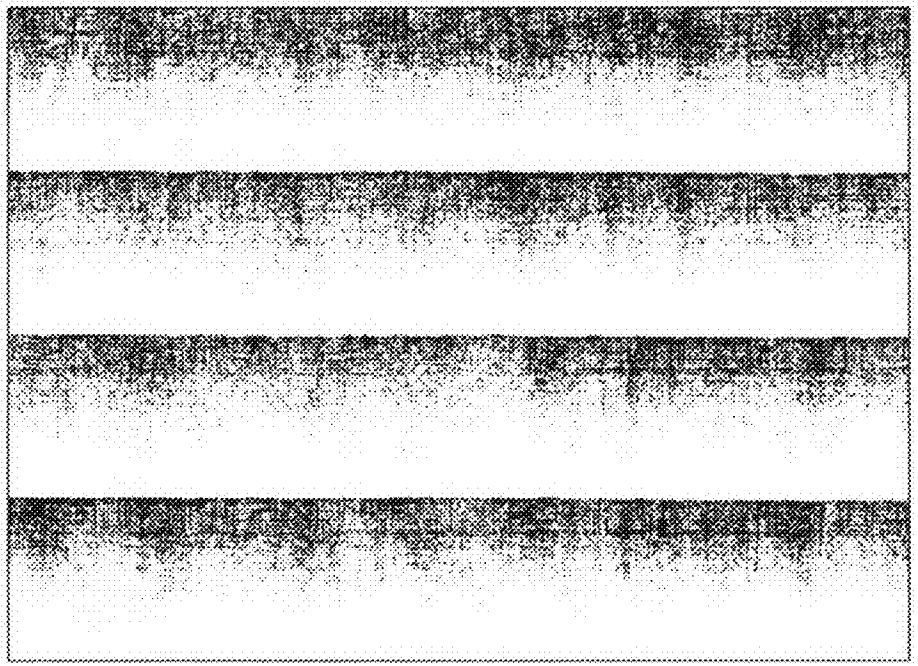
FIG. 5 is a schematic plan view showing a display state of a display apparatus for reference.

Therefore, irregularity like a stripe appears in a period of a plurality of lines (hereinafter referred to as block) among which the power supplying timing is common as seen in FIG. 5. It is to be noted that, in FIG. 5, the irregularity is illustrated in an exaggerated fashion.

Figure 6:
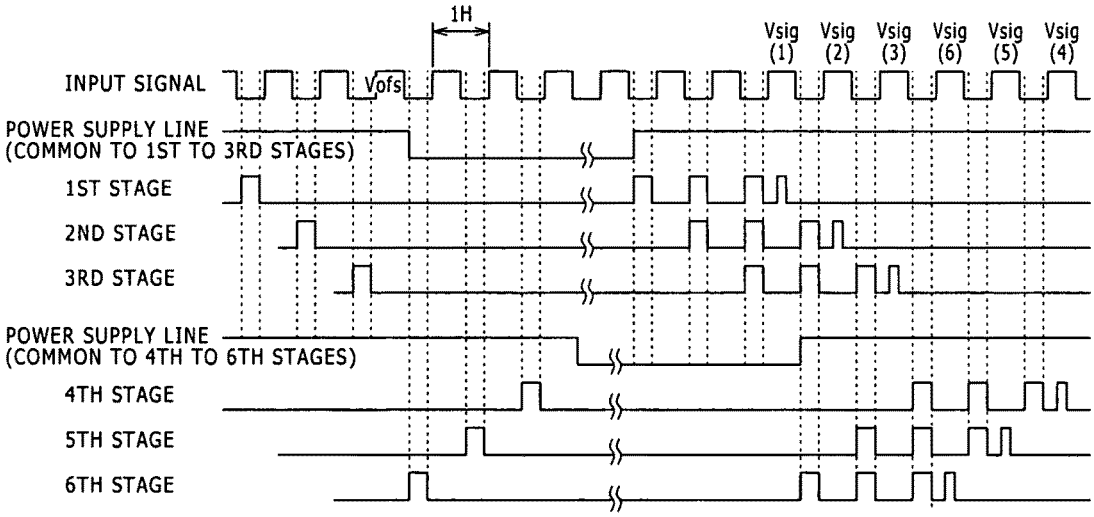
FIG. 6 is a timing chart illustrating operation of the display apparatus shown in FIG. 1.
Figure 7:
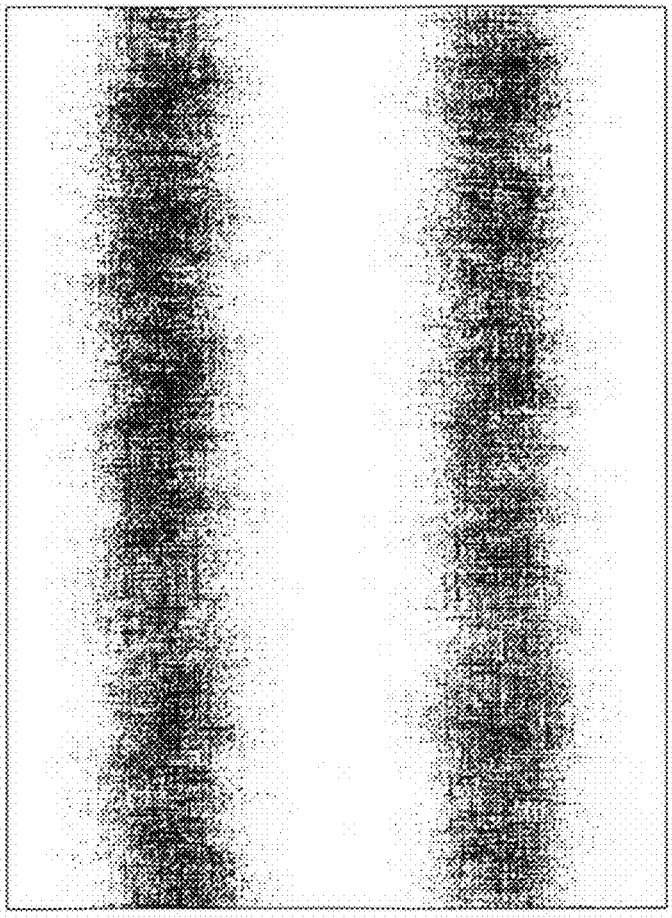
FIG. 7 is a schematic plan view showing a display state of the display apparatus shown in FIG. 1.

The present invention proposes to reverse the scanning direction of sampling transistors in a block between adjacent blocks as a countermeasure for the problem described above. As an example, a timing relationship where the present invention is applied is illustrated in FIG. 6. The timing chart of FIG. 6 is substantially same as that of FIG. 3A. The timing relationship according to the present invention is different from that of FIG. 3A in that the period of time after the power supply voltage is changed from the low potential Vss to the high potential Vcc until the threshold value correction operation is carried out is equal between adjacent lines of adjacent blocks and that the output order of the signal voltage inputted to the pixels is reversed between adjacent blocks.

Where the present invention is applied, the period of time after the power supply line is changed to the high potential Vcc until the threshold value correction operation is carried out can be made equal between adjacent lines of adjacent blocks, and the rise amount of the source voltage of the driving transistor by leak current of the driving transistor or the light emitting element EL can be made equal between adjacent lines of adjacent blocks. As a result, such stripe irregularity between blocks visually observed as seen in FIG. 5 before the countermeasure is taken can be replaced by such irregularity like shading as seen in FIG. 7. It is to be noted that, in FIGS. 5 and 7, the shading irregularity is represented in an exaggerated fashion from an actual one. Although generally such irregularity like a stripe which varies suddenly between adjacent blocks is visually observed in a luminance difference by approximately 1%, such irregularly as shading which exhibits moderate variation cannot be visually observed in a luminance difference by approximately 1%, and therefore, where the present invention is applied, uniform picture quality whose irregularly is not visually observed can be obtained. Further, where the present invention is applied, since irregularly is not visually observed even if the number of lines which form a block is increased, it is possible to increase the number of lines which form a block, that is, to decrease the number of blocks of the panel in comparison with known apparatus thereby to achieve reduction in cost. Further, since the present invention adopts the method wherein the scanning direction of the sampling transistor is reversed between every adjacent block, where the panel does not have a gate driver built therein, preferably a gate driver is provided for each unit.

Figure 8A:
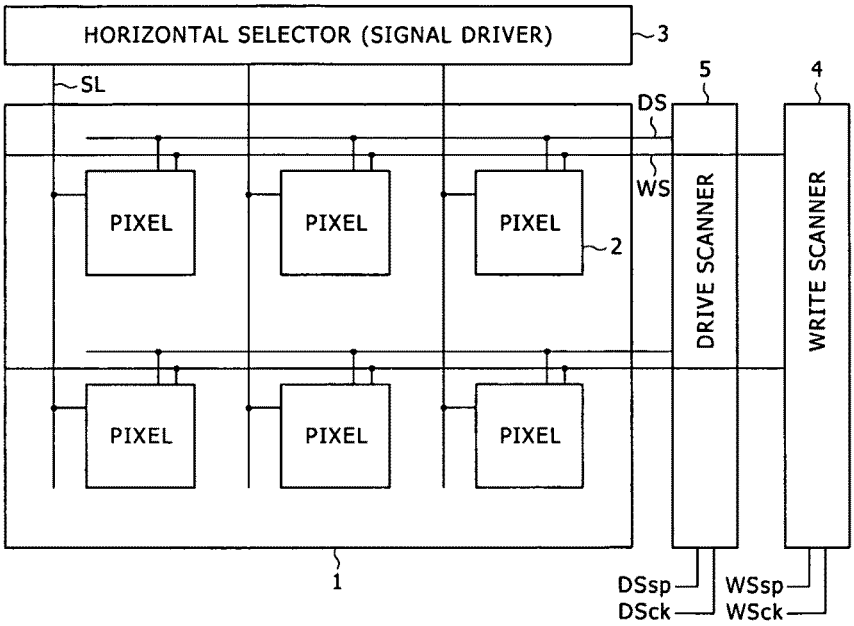
FIG. 8A is a block diagram showing a general configuration of a display apparatus according to a second embodiment of the present invention.

Referring first to FIG. 8A, there is shown a general configuration of a display apparatus according to the second embodiment of the present invention. The display apparatus shown includes a pixel array section 1, and driving sections 3, 4 and 5 for driving the pixel array section 1. The pixel array section 1 includes a plurality of scanning lines WS extending along the direction of a row, a plurality of signal lines SL extending along the direction of a column, a plurality of pixels 2 disposed in rows and columns at places at which the scanning lines WS and the signal lines SL intersect with each other, and a plurality of feed lines DS serving as power supply lines disposed corresponding to the rows of the pixels 2. The driving sections 3, 4 and 5 include a controlling scanner or write scanner 4 for successively supplying a control signal to the scanning lines WS to line-sequentially scan the pixels 2 in a unit of a row, a power supply scanner or drive scanner 5 for supplying a power supply potential which is changed over between a first potential and a second potential to each of the feed lines DS in response to the line-sequential scanning, and a signal driver or horizontal selector 3 for supplying a signal potential serving as an image signal and a reference potential to the signal lines SL in the columns in response to the line-sequential scanning. It is to be noted that the controlling scanner 4 operates in response to a clock signal WSck supplied thereto from the outside to successively transfer a start pulse WSsp supplied similarly from the outside to output a control signal to the scanning lines WS. The drive scanner 5 operates in response to a clock signal DSck supplied from the outside to successively transfer a start pulse DSsp supplied similarly from the outside to line-sequentially change over the potential of the feed lines DS. The present display apparatus is different from the that of the first embodiment described hereinabove with reference to FIG. 1 in that the feed lines DS are not made common in a unit of a block.

Figure 8B:
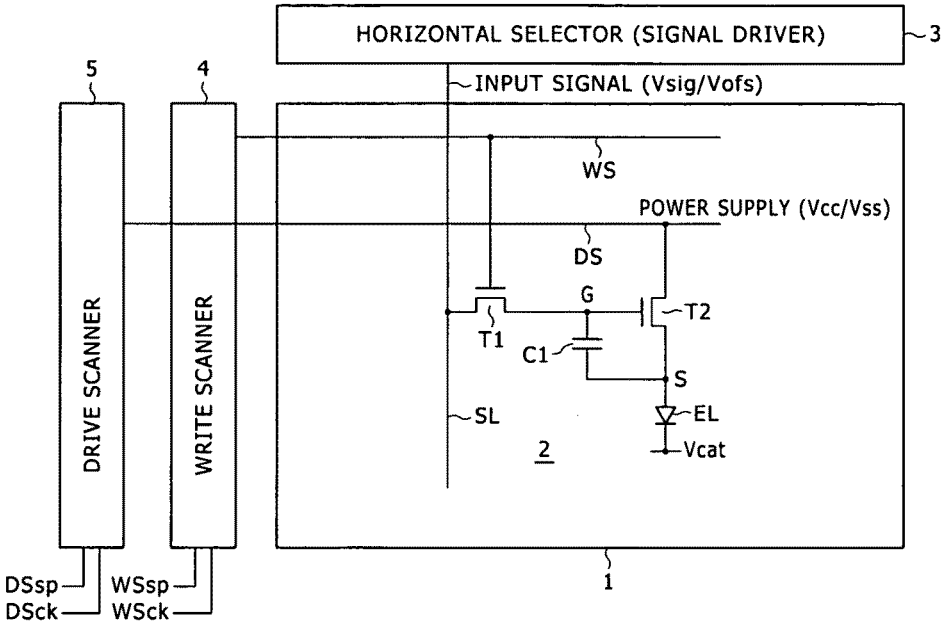
FIG. 8B is a circuit diagram showing an example of a pixel formed in the display apparatus shown in FIG. 8A.

FIG. 8B shows a circuit diagram showing a particular configuration of the pixels 2 included in the display apparatus shown in FIG. 8A. Referring to FIG. 8B, each pixel circuit 2 includes a light emitting element EL of the two-terminal type or diode type represented by an organic EL device, a sampling transistor T1 of the N-channel type, a driving transistor T2 similarly of the N-channel type, and a storage capacitor C1 of the thin film type. The sampling transistor T1 is connected at the gate thereof, which serves as a control terminal, to a scanning line WS, at one of the source and the drain thereof which serve as current terminals, to a signal line SL, and at the other one of the source and the drain thereof, to the gate G of the driving transistor T2. The driving transistor T2 is connected at one of the source and the drain thereof to the light emitting element EL and at the other one of the source and the drain thereof to a feed line DS. In the present embodiment, the driving transistor T2 is of the N-channel type and is connected at the drain side thereof, which is one of the current terminals, to the feed line DS and at the source S side thereof, which is the other current terminal, to the anode side of the light emitting element EL. The light emitting element EL is connected at the cathode thereof and fixed to a predetermined cathode potential Vcat. The storage capacitor C1 is connected between the source S as the current terminal and the gate G as the control terminal of the driving transistor T2. The controlling scanner or write scanner 4 changes over the potential to the scanning line WS between the low potential and the high potential to output a sequential control signal to the pixels 2 having such a configuration as described above thereby to line-sequentially scan the pixels 2 in a unit of a row. The power supply scanner or driver scanner 5 supplies a power supply potential, which changes over between a first potential Vcc and a second potential Vss, to the feed lines DS in response to the line-sequential scanning. The signal driver or horizontal selector 3 supplies a signal potential Vsig, which is an image signal, and a reference potential Vofs to the signal lines SL extending in the column direction in synchronism with the line-sequential scanning.

In the display apparatus having the configuration described above, the sampling transistor T1 samples and writes the signal potential Vsig into the storage capacitor C1 within a sampling period from a second timing at which the control signal rises after a first timing at which the image signal rises from the reference potential Vofs to the signal potential Vsig to a third timing at which the control signal falls, that is, between the second timing and the third timing, to turn off the sampling transistor T1. Simultaneously, the current flowing through the driving transistor T2 is negatively fed back to the storage capacitor C1 to apply correction for the mobility μ of the driving transistor T2 to the signal potential written in the storage capacitor C1. In other words, the sampling period from the second timing to the third timing serves also as a mobility correction period within which the current flowing through the driving transistor T2 is negatively fed back to the storage capacitor C1.

The pixel circuit shown in FIG. 8B includes a threshold voltage correction function in addition to the mobility correction function described above. In particular, the power supply scanner or driver scanner 5 changes over the potential to the feed line DS from the first potential Vcc to the second potential Vss at the first timing before the sampling transistor T1 samples the signal potential Vsig. Similarly, before the sampling transistor T1 samples the signal potential Vsig, the controlling scanner or write scanner 4 renders the sampling transistor T1 conducting to apply the reference potential Vofs from the signal line SL to the gate G of the driving transistor T2 to set the source S of the driving transistor T2 to the second potential Vss and set the source S of the driving transistor T2 to the second potential Vss. At the third timing after the second timing, the power supply scanner or drive scanner 5 changes over the potential to the feed line DS from the second potential Vss to the first potential Vcc to store a voltage corresponding to the threshold voltage Vth of the driving transistor T2 into the storage capacitor C1. By such threshold voltage correction function as just described, the present display apparatus can cancel the influence of the threshold voltage Vth of the driving transistor T2 which disperses for each pixel. It is to be noted that the order in time of the first timing and the second timing may be reversed.

The pixel circuit 2 shown in FIG. 8B further includes a bootstrap function. In particular, the controlling scanner 4 places the sampling transistor T1 into a non-conducting state to electrically disconnect the gate G of the driving transistor T2 from the signal line SL at a point of time at which the signal potential Vsig is stored into the storage capacitor C1. Consequently, the gate potential of the driving transistor T2 varies in an interlocking relationship with the variation of the source potential of the driving transistor T2 thereby to keep the gate-source voltage Vgs between the gate G and the source S of the driving transistor T2 fixed. Even if the current-voltage characteristic of the light emitting element EL varies as time passes, the gate-source voltage Vgs can be kept fixed, and no variation of the luminance occurs.

Figure 9:
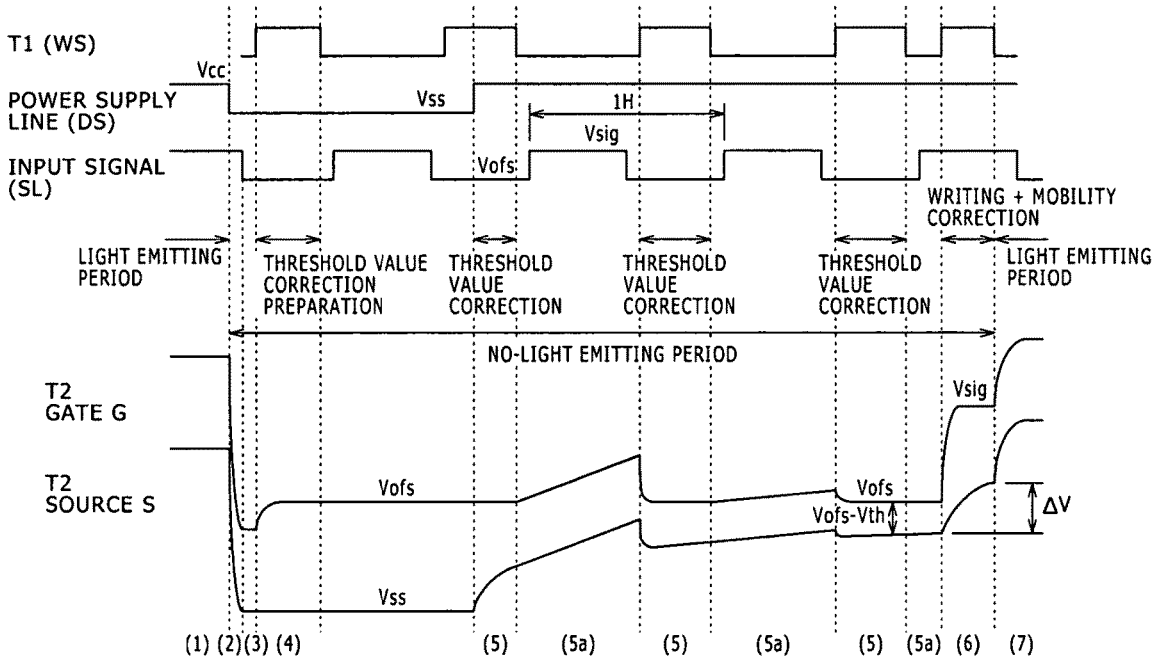
FIG. 9 is a timing chart illustrating operation of the pixel shown in FIG. 8A.

FIG. 9 illustrates operation of the pixel shown in FIG. 8B. The timing chart of FIG. 9 illustrates the potential variation of the scanning line WS, the potential variation of the feed line or power supply line DS and the potential variation of the signal line SL with respect to the common time axis. The potential variation of the scanning line WS represents the control signal and controls the sampling transistor T1 between open and closed state. The potential variation of the feed line DS represents changeover between the power supply voltages Vcc and Vss. The potential variation of the signal line SL represents changeover between the signal potential Vsig and the reference potential Vofs of the input signal. In parallel to the potential variations mentioned, also the potential variations of the gate G and the source S of the driving transistor T2 are illustrated. The potential difference Vgs is the potential difference between the gate G and the source S as described hereinabove.

The period of the timing chart of FIG. 9 is divided into divisional periods (1) to (7) in accordance with the transition of the operation of the pixel for the convenience of description. Within the period (1) immediately prior to the pertaining field, the light emitting element EL is in a light emitting state. Thereafter, the new field of the line-sequential scanning is entered, and within the first period (2), the potential of the feed line DS is changed over from the first potential Vcc to the second potential Vss. Then, within the next period (3), the input signal is changed over from the signal potential Vsig to the reference potential Vofs. Further, within the period (4), the sampling transistor T1 is turned on. Within the periods (2) to (4) described, the gate voltage and the source voltage of the driving transistor T2 are initialized. The periods (2) to (4) are a preparation period for threshold voltage correction, within which the gate G of the driving transistor T2 is initialized to the reference potential Vofs and the source S of the driving transistor T2 is initialized to the second potential Vss. Then, within the threshold value correction period (5), a threshold voltage correction operation is carried out actually, and a voltage corresponding to the threshold voltage Vth is stored between the gate G and the source S of the driving transistor T2. Actually, the voltage corresponding to the threshold voltage Vth is written into the storage capacitor C1 connected between the gate G and the source S of the driving transistor T2.

It is to be noted that, in the example of FIG. 9, the threshold correction period (5) is provided three times and the threshold voltage correction operation is carried out time-divisionally. A waiting period 5*a* is inserted between the threshold correction periods (5). By dividing the threshold voltage correction period (5) to repeat the threshold voltage correction operation by a plural number of times in this manner, a voltage corresponding to the threshold voltage Vth is written into the storage capacitor C1. It is to be noted, however, that the present invention is not limited to this, but the correction operation may be carried out within one threshold voltage correction period (5).

Thereafter, the writing operation period/mobility correction period (6) is entered. Here, the signal potential Vsig of the image signal is written in an accumulated manner into the storage capacitor C1 while a voltage ΔV for mobility correction is subtracted from the voltage stored in the storage capacitor C1. Within the writing operation period/mobility correction period (6), it is necessary to place the sampling transistor T1 into a conducting state within a time zone within which the signal line SL remains having the signal potential Vsig. Thereafter, the light emitting period (7) is entered, and the light emitting element emits light with a luminance corresponding to the signal potential Vsig. Thereupon, since the signal potential Vsig is adjusted with the voltage corresponding to the threshold voltage Vth and the voltage ΔV for mobility correction, the emission light luminance of the light emitting element EL is not influenced by the dispersion of the threshold voltage Vth or the mobility μ of the driving transistor T2. It is to be noted that a bootstrap operation is carried out at the beginning of the light emitting period (7), and while the gate-source voltage Vgs of the driving transistor T2 is kept fixed, the gate potential and the source potential of the driving transistor T2 rise.

Figure 10A:
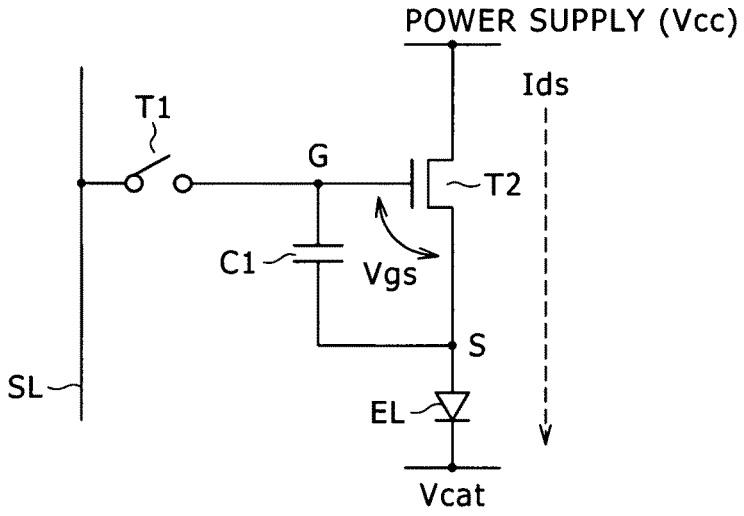
FIGS. 10A to 10D are circuit diagrams illustrating operation of the pixel shown in FIG. 8B.

Operation of the pixel circuit shown in FIG. 8B is described in detail with reference to FIGS. 10A to 12. First, within the light emitting period (1), as seen in FIG. 10A, the power supply potential is set to the first potential Vcc and the sampling transistor T1 is in an off state. At this times, since the driving transistor T2 is set so as to operate in a saturation region, the driving current Ids flowing through the light emitting element EL assumes a value given by the transistor characteristic expression mentioned hereinabove in response to the gate-source voltage Vgs applied between the gate G and the source S of the driving transistor T2.

Figure 10B:
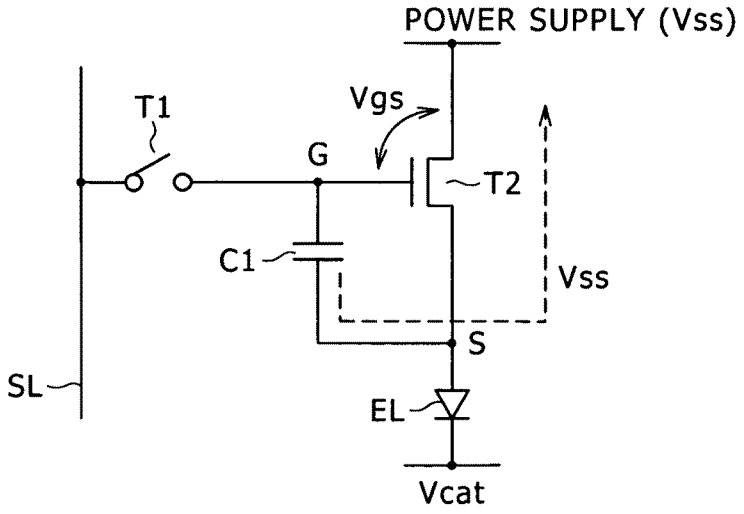

Then, after the preparation period (2) and (3) is entered, the potential of the feed line or power supply line DS is changed to the second potential Vss as seen in FIG. 10B. At this time, the second potential Vss is set so as to be lower than the sum of the threshold voltage Vthel and the cathode potential Vcat of the light emitting element EL. In other words, Vss<Vthel+Vcat is satisfied. Therefore, the light emitting element EL is turned off and the power supply line side becomes the source of the driving transistor T2. At this time, the anode of the light emitting element EL is charged to the second potential Vss.

Figure 10C:
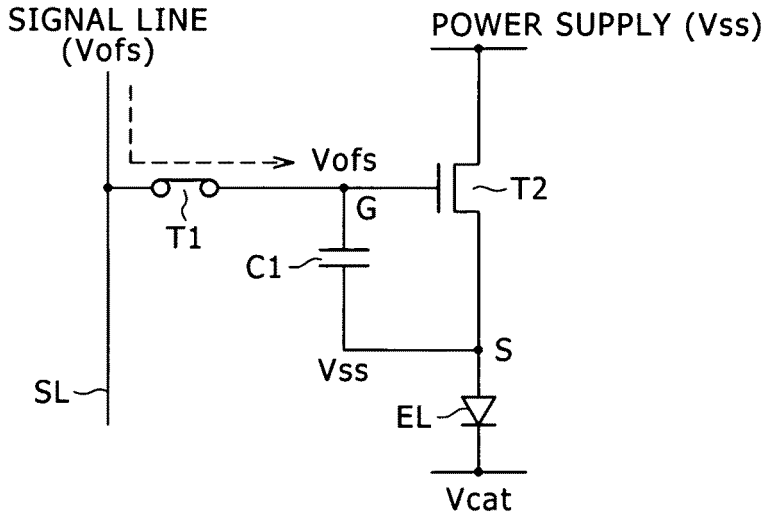

Then, after the next preparation period (4) is entered, while the potential of the signal line SL becomes the reference potential Vofs, the sampling transistor T1 is turned on to set the gate potential of the driving transistor T2 to the reference potential Vofs as seen in FIG. 10C. The source S and the gate G of the driving transistor T2 upon light emission are initialized in this manner, and the gate-source voltage Vgs at this time becomes the value of Vofs−Vss. The gate-source voltage Vgs=Vofs−Vss is set so as to have a value higher than the threshold voltage Vth of the driving transistor T2. By initializing the driving transistor T2 such that Vgs>Vth is satisfied in this manner, preparations for a succeeding threshold voltage correction operation are completed.

Figure 10D:
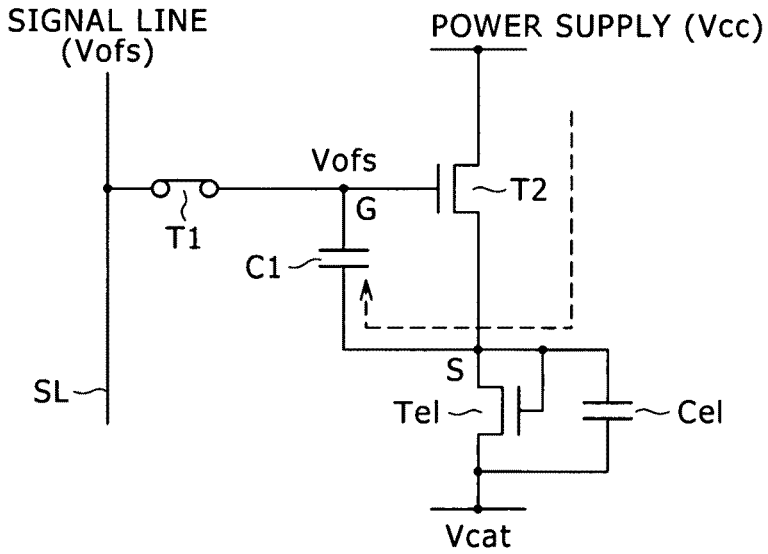

Then, after the threshold voltage correction period (5) is entered, the potential of the feed line or power supply line DS returns to the first potential Vcc as seen in FIG. 10D. When the power supply voltage becomes the first potential Vcc, the potential of the anode of the light emitting element EL becomes the potential of the source S of the driving transistor T2, and current flows as indicated by a broken line arrow mark in FIG. 10C. At this time, the equivalent circuit of the light emitting element EL is represented by a parallel connection of a diode Tel and a capacitor Cel. Since the anode potential of the light emitting element EL, that is, the source potential Vss, is lower than Vcat+Vthel, the diode Tel is in an off state, and leak current flowing through the diode Tel is considerably lower than the current flowing through the driving transistor T2. Therefore, almost all of the current flowing through the driving transistor T2 is used to charge up the storage capacitor C1 and the equivalent capacitor Cel.

Figure 10E:
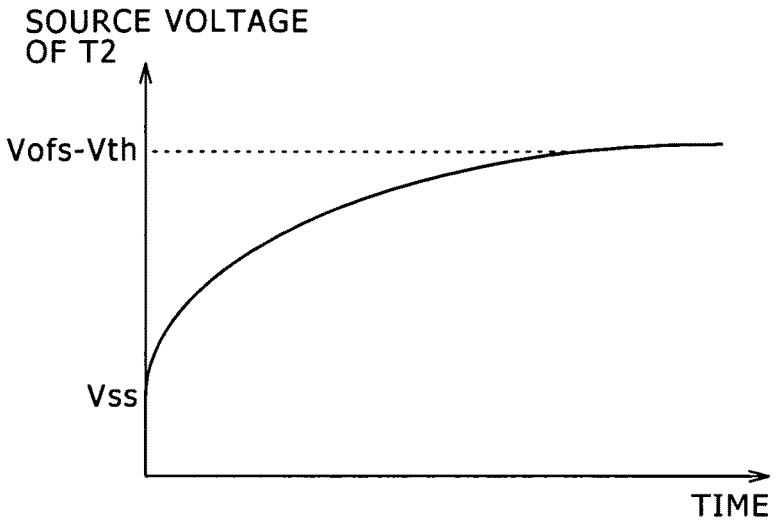
FIG. 10E is a graph illustrating operation of the pixel shown in FIG. 8B.

FIG. 10E illustrates a time variation of the source potential of the driving transistor T2 within the threshold voltage correction period (5) illustrated in FIG. 10D. Referring to FIG. 10E, the source voltage of the driving transistor T2, that is, the anode voltage of the light emitting element EL, rises from the second potential Vss as time passes. After the threshold voltage correction period (5) passes, the driving transistor T2 is cut off, and the gate-source voltage Vgs between the source S and the gate G of the driving transistor T2 becomes equal to the threshold voltage Vth. At this time, the source potential is given by Vofs−Vth. If this value Vofs−Vth still remains lower than Vcat+Vthel, then the light emitting element EL is in a cutoff state.

Figure 11A:
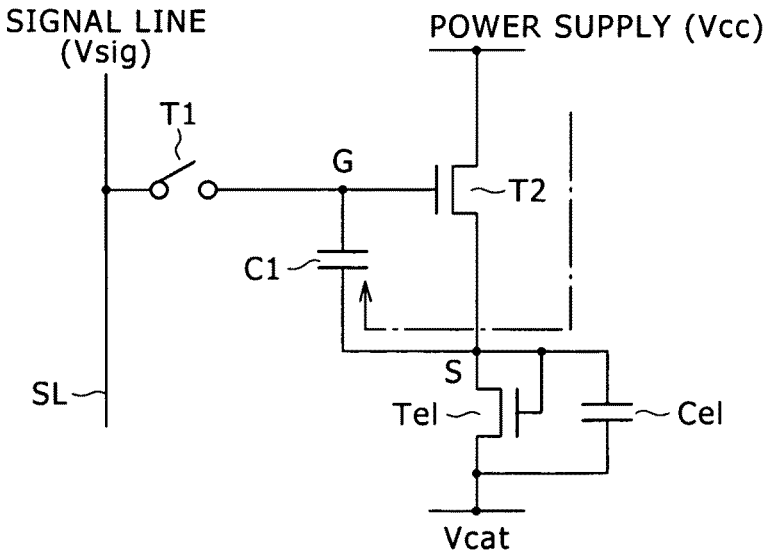
FIGS. 11A and 11B are circuit diagrams illustrating operations of the pixel shown in FIG. 8B.

As seen from FIG. 10E, the source potential of the driving transistor T2 rises as time passes. However, in the present example, before the source voltage of the driving transistor T2 reaches Vofs−Vth, the first time threshold voltage correction period (5) comes to an end, and therefore, the sampling transistor T1 is turned off and the waiting period (5*a*) is entered. FIG. 11A illustrates a state of the pixel circuit within this waiting period (5*a*). Within this first time waiting period (5*a*), since the gate-source voltage Vgs of the driving transistor T2 still remains higher than the threshold voltage Vth, current flows from the power supply Vcc to the storage capacitor C1 through the driving transistor T2 as seen in FIG. 11A. Consequently, although the source voltage of the driving transistor T2 rises, since the sampling transistor T1 is in an off state and the gate G of the driving transistor T2 is in a high impedance state, also the potential of the gate G of the driving transistor T2 raises together with the potential rise of the source S. In other words, within the first-time waiting period (5*a*), both of the source potential and the gate potential of the driving transistor T2 rise by the bootstrap operation. At this time, since the reverse bias continues to be applied to the light emitting element EL, the light emitting element EL emits no light.

Thereafter, when the time of 1H passes and the potential of the signal line SL becomes the reference potential Vofs, the sampling transistor T1 is turned on to start the second time threshold voltage correction operation. Thereafter, when the second time threshold voltage correction period (5) elapses, the second time waiting period (5*a*) is entered. By repeating the threshold voltage correction period (5) and the waiting period (5*a*) in this manner, the gate-source voltage Vgs of the driving transistor T2 finally reaches a voltage corresponding to the threshold voltage Vth. At this time, the source potential of the driving transistor T2 is Vofs−Vth and is lower than Vcat+Vthel.

Figure 11B:
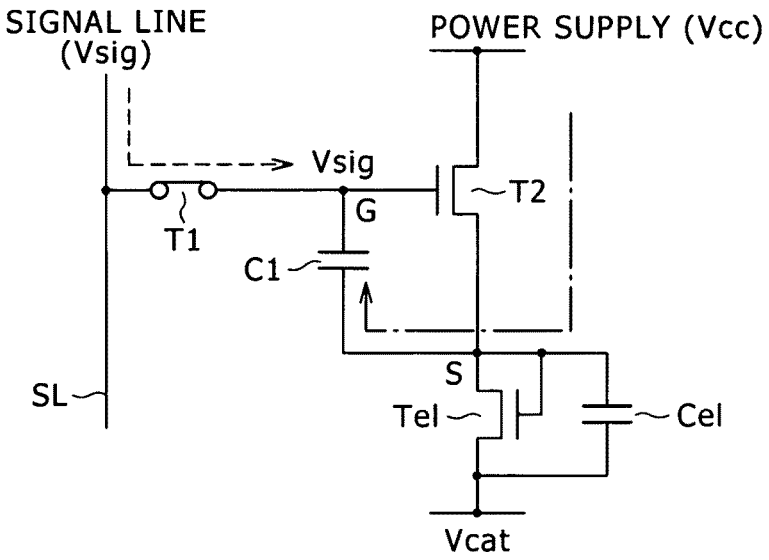

Thereafter, when the writing operation period/mobility correction period (6) is entered, the potential of the signal line SL is changed over from the reference potential Vofs to the signal potential Vsig and then the sampling transistor T1 is turned on as seen in FIG. 11B. At this time, the signal potential Vsig has a voltage value according to a gradation. Since the sampling transistor T1 is on, the gate potential of the driving transistor T2 becomes the signal potential Vsig. Meanwhile, the source potential of the driving transistor T2 rises as time passes because current flows therethrough from the first potential Vcc. Also at this time, if the source potential of the driving transistor T2 does not exceed the sum of the threshold voltage Vthel of the light emitting element EL and the cathode potential Vcat, then the current flowing from the driving transistor T2 is used only for charging of the capacitor equivalent Cel and the storage capacitor C1. At this time, since the threshold voltage correction operation of the driving transistor T2 has been completed already, the current supplied from the driving transistor T2 reflects the mobility μ. Particularly, where the driving transistor T2 has a high mobility μ, the current amount at this time is great and also the potential rise amount ΔV of the source is great. On the contrary, where the driving transistor T2 has a low mobility μ, the current amount of the driving transistor T2 is small and the potential rise amount ΔV of the source is small. By such operation, the gate-source voltage Vgs of the driving transistor T2 is compressed by the potential rise amount ΔV reflecting the mobility μ, and at a point of time at which the mobility correction period (6) comes to an end, the gate-source voltage Vgs from which the mobility μ is eliminated completely is obtained.

Figure 11C:
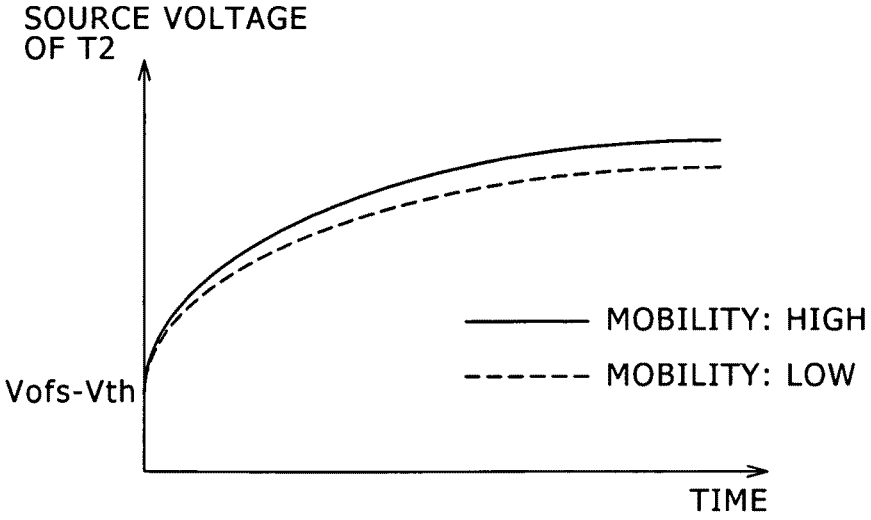
FIG. 11C is a graph illustrating operation of the pixel shown in FIG. 8B.

FIG. 11C illustrates a variation with respect to time of the source potential of the driving transistor T2 within the mobility correction period (6) described above. As seen from FIG. 11, where the mobility of the driving transistor T2 is high, the source voltage of the driving transistor T2 rises quickly and the gate-source voltage Vgs is compressed as much. In other words, where the mobility μ is high, the gate-source voltage Vgs is compressed so as to cancel the influence of the mobility p, and the driving current can be suppressed. On the other hand, where the mobility μ is low, the source voltage of the driving transistor T2 does not rise very quickly, and also the gate-source voltage Vgs is not compressed very strongly. Accordingly, where the mobility μ is low, the gate-source voltage Vgs is not compressed very much so as to supplement the low driving capacity.

Figure 12:
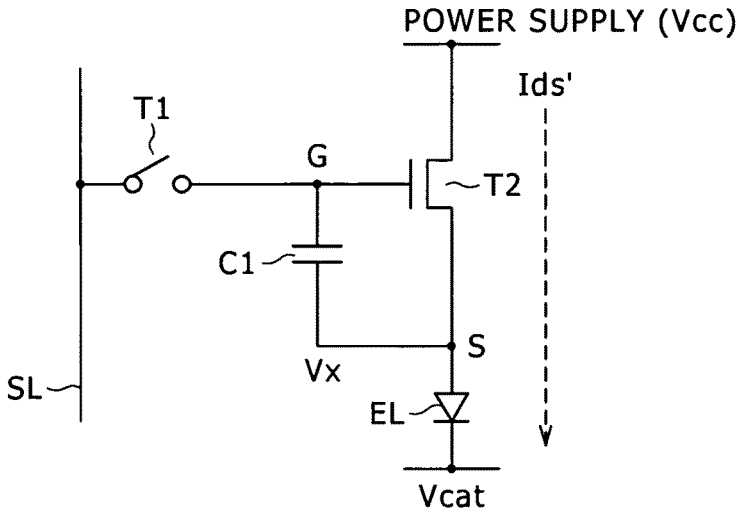
FIG. 12 is a circuit diagram illustrating an operation of the pixel shown in FIG. 8B.
Figure 13:
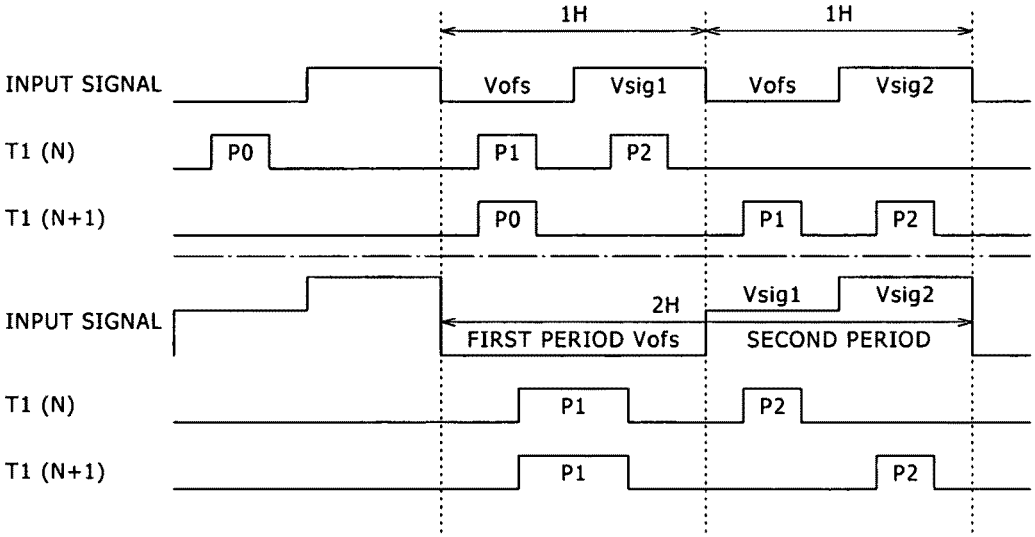
FIG. 13 is a timing chart illustrating operation of the pixel shown in FIG. 8B.

FIG. 12 illustrates an operation state within the light emitting period (7). Within the light emitting period (7), the sampling transistor T1 is turned off to cause the light emitting element EL to emit light. The gate-source voltage Vgs of the driving transistor T2 is kept fixed, and the driving transistor T2 supplies fixed driving current Ids in accordance with the characteristic expression given hereinabove to the light emitting element EL. Since driving current Ids' flows through the light emitting element EL, the anode voltage of the light emitting element EL, that is, the source voltage of the driving transistor T2, rises up to Vx, and at a point of time at which the voltage exceeds Vcat+Vthel, the light emitting element EL emits light. As the light emission time becomes long, the current/voltage of the light emitting element EL varies. As a result, the potential of source S varies as shown in FIG. 11C. However, since the gate-source voltage Vgs of the driving transistor T2 is kept at a fixed value by the bootstrap operation, the driving current Ids' flowing through the light emitting element EL does not vary. Therefore, even if the current/voltage characteristic of the light emitting element EL deteriorates, the fixed driving current Ids' require flows, and the luminance of the light emitting element EL does not vary at all.

Incidentally, as enhancement of the definition and increase of the operation speed of a display apparatus proceed, the 1H period becomes shorter, and also in this instance, in the operation sequence of the reference example described hereinabove with reference to FIG. 3, it is necessary to complete a threshold voltage correction operation and a signal potential writing operation within the last 1H period. Thereupon, it is necessary to take the transient time periods of the input signal and the control signal into consideration and carry out inputting of the reference potential Vofs to the signal line SL, the threshold voltage correction operation, a turning off operation of the sampling transistor T1, inputting of the signal potential Vsig to the signal line SL, a signal potential writing operation and a turning off operation of the sampling transistor T1 within the period of 1H. Actually, however, since the period of 1H is shortened considerably as the enhancement of the definition and the increase of the speed of a display apparatus proceed, it is difficult to satisfy the relationship described above and besides complete the threshold value correction operation and the signal potential writing operation within the period of 1H.

Figure 14:
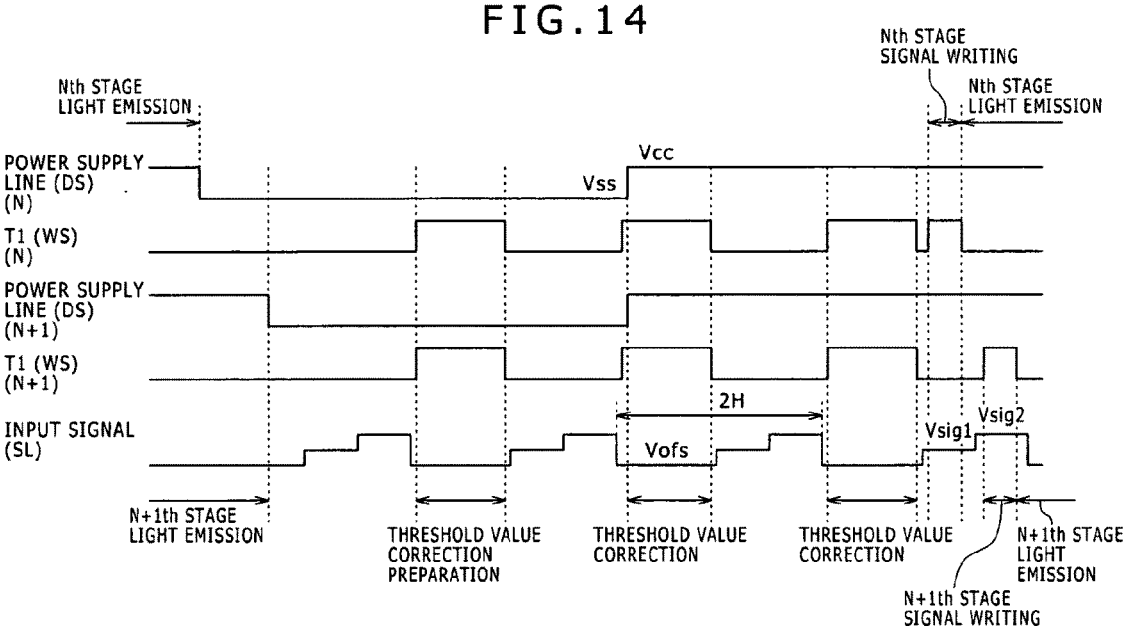
FIG. 14 is a timing chart illustrating a driving method for the display apparatus shown in FIG. 8B.

In order to cope with the problems of the reference example described above, the present invention combines a plurality of horizontal periods and carries out the threshold value correction operation commonly within part of the combined period. Thereafter, the signal potential writing operation is carried out in order within the remaining part of the combined period. FIG. 14 schematically illustrates an example of an operation sequence where two horizontal periods (2H) are combined. It is to be noted that an operation sequence of the reference example described hereinabove is shown on the upper stage of the timing chart for comparison, and the operation sequence of the present embodiment is illustrated on the lower stage. In the operation sequence of the reference example, the input signal changes over between the reference potential Vofs and the signal potential Vsig in a unit of 1H. To the sampling transistor T1(N) for the Nth line, a control signal including three pulses P0, P1 and P2 is successively applied. The sampling transistor T1(N) turns on in response to the pulses P0, P1 and P2. The control signal shifted rearwardly by 1H and including three pulses P0, P1 and P2 similarly is applied to the sampling transistor T1(N+1) for the N+1th line. Within the first 1H period, when the input signal has the reference potential Vofs, the sampling transistor T1(N) turns on in response to the control pulse P1 to carry out a threshold voltage correction operation. Thereafter, when the input signal changes to a signal potential Vsig1 within the same 1H period, the sampling transistor T1(N) turns on in response to the control pulse P2 to carry out a signal potential writing operation. The sampling transistor T1(N) of the Nth line completes the threshold voltage correction operation and the signal potential writing operation within the first horizontal period in this manner. It is to be noted that, at this time, the sampling transistor T1(N+1) of the next line turns on in response to the control pulse P0 to carry out a first time threshold voltage correction operation.

After the second time horizontal period is entered, when the input signal is the reference potential Vofs, the sampling transistor T1(N+1) of the N+1th line turns on in response to the control pulse P1 to carry out a second time threshold voltage correction operation. Then, when the input signal changes over from the reference potential Vofs to a signal potential Vsig2, the sampling transistor T1(N+1) turns on in response to the control pulse P2 to carry out a signal potential writing operation. In this manner, the sampling transistor for each line completes the threshold voltage correction operation and the signal potential writing operation within a period of 1H. In the present reference example, since the correction is not completed by the first time threshold voltage correction operation, the threshold voltage correction operation is carried out divisionally twice and repetitively.

In contrast, in the operation sequence according to the present embodiment, the write scanner combines a plurality of scanning periods (1H) individually allocated to different scanning lines (in the present embodiment, two scanning lines) to form a composite period of a first period and a second period. In other words, this composite scanning period corresponds to 2H. Within the first period, the control pulse P1 is outputted at a time to the two scanning lines (Nth line and N+1th line) to carry out a threshold voltage correction operation at a time. Then, within the second period, the control pulse P2 is outputted to the two scanning lines (Nth line and N+1th line) to execute a sequential signal potential writing operation. In the example, the input signal is the reference potential Vofs within the first period which corresponds to the front half of the composite scanning period 2H and changes in order from the signal potential Vsig to the signal potential Vsig2 within the second period of the latter half of the composite scanning period 2H. At this time, the sampling transistor T1(N) of the Nth line turns on in response to the control pulse P2 and samples the signal potential Vsig1. Then, the sampling transistor T1(N+1) of the N+1th line turns on in response to the control pulse P2 and samples the signal potential Vsig2.

FIG. 14 illustrates a general configuration of an operation sequence of the display apparatus of the present invention including a potential variation of a power supply line. Referring to FIG. 15B, the waveforms of the control signals applied to the sampling transistors T1(N) and T1(N+1) are common within a correction preparation period and a threshold voltage correction period for the Nth line and the N+1th line. On the other hand, the difference between the signal writing time period for the pixels of the Nth line and the signal writing time period for the pixel of the N+1th line is smaller than 1H. Further, the difference of the time period in which the feed line DS becomes the second potential Vss, that is, a starting timing of a no-light emitting period between the Nth line and the N+1th line is smaller than 1H. After the gate of the driving transistor is set to the reference potential Vofs and the source of the driving transistor is set to the second potential Vss when no light is emitted, the power supply line is changed over from the second potential Vss to the first potential Vcc to carry out a divisional threshold voltage correction operation. Thereafter, while mobility correction is carried out, the signal potentials Vsig1 and Vsig2 are written into the storage capacitors of the respective lines to cause the light emitting elements EL to emit light. In this manner, in the present operation sequence, sequential control signals are outputted to the Nth and N+1th scanning lines WS with a phase difference smaller than one scanning period (1H) within the second period. The power supply scanner supplies the second potential Vss to a plurality of feed lines DS corresponding to the plurality of scanning lines WS (Nth and N+1th scanning lines WS) in order to implement a threshold voltage correction operation within the first period and then changes over the potential to be supplied to the first potential Vcc at a time. Thereupon, within the first period, the power supply scanner supplies the second potential Vss to the plurality of feed lines DS (Nth and N+1th feed lines DS) with a phase difference smaller than one scanning period (1H) within the first period and then changes over the potential to be supplied to the first potential Vcc.

As described above, according to the present invention, a plurality of scanning lines are divided into blocks each including a predetermined number of scanning lines, and the scanning lines allocated to each predetermined number of scanning lines are combined to form one composite period including a first period and a second period. In FIG. 14, in order to facilitate understandings, the scanning lines are divided for each two into blocks, and one horizontal period (1H) each allocated to one of the two scanning lines are combined into one composite period (2H) which is divided into a first period and a second period. The timing chart of FIG. 14 illustrates an operation sequence for one block including the Nth scanning line and the N+1th scanning line.

Figure 15A:
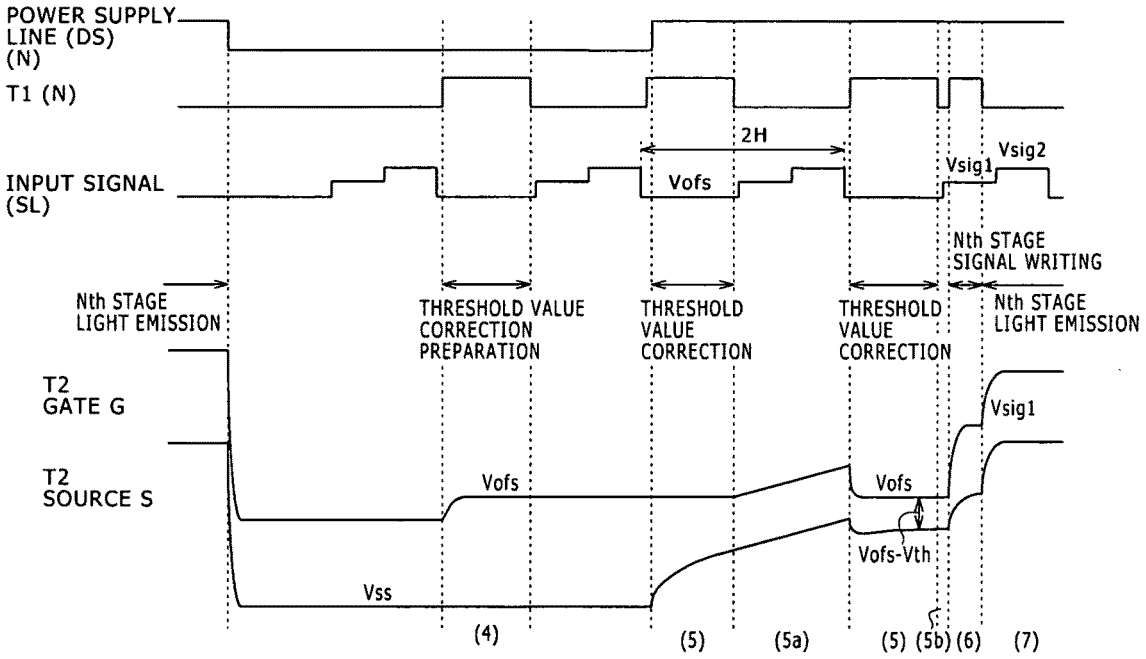
FIGS. 15A and 15B are waveform diagrams illustrating operation of the display apparatus shown in FIG. 8A.
Figure 15B:
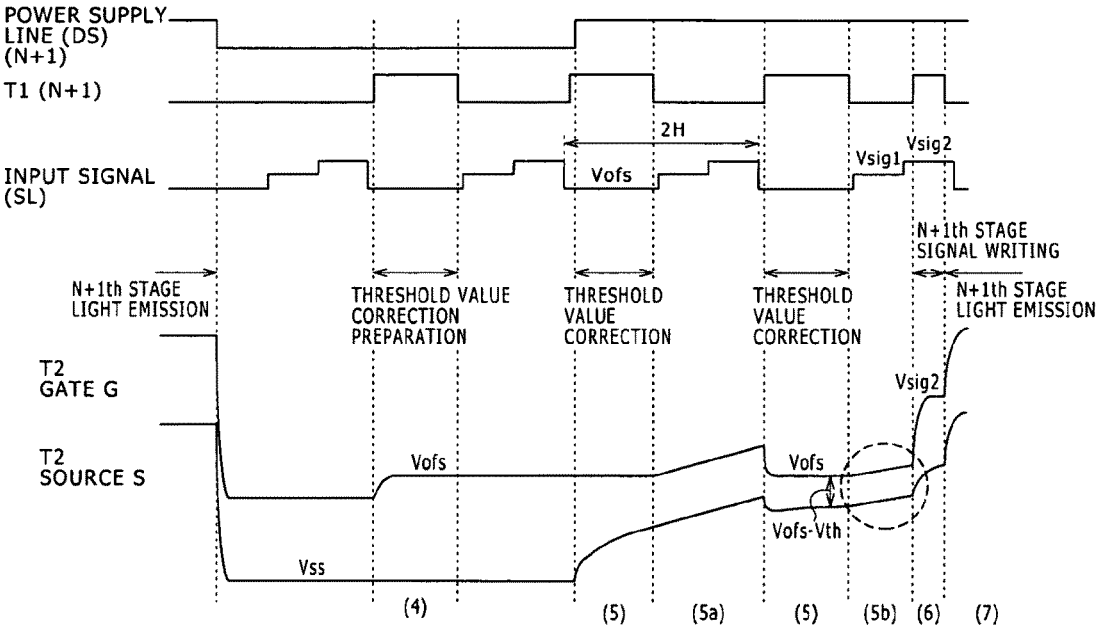

FIG. 15A illustrates a variation of the gate potential and the source potential of the driving transistor T2 included in the pixels of the Nth line. Also a variation of the potential of the power supply line DS, a variation of the control signal for the sampling transistor T1 and a potential variation of the input signal supplied to the signal line SL. The pixels in the Nth line carry out predetermined operations within a correction preparation period (4), a threshold voltage correction period (5), a signal writing period (6) and so forth in response to the potential variation of the power supply line DS and the variations of the control signal and the input signal of the sampling transistor T1.

Within the correction preparation period (4), the gate G of the driving transistor T2 is set to the reference potential Vofs and the source S of the driving transistor T2 is set to the second potential Vss. Then, within the second time threshold voltage correction period (5) after the first time threshold voltage correction period (5) and weighting period (5*a*), the voltage Vgs between the gate G and the source S of the driving transistor T2 is fixed to a voltage corresponding to the threshold voltage Vth.

Then, the signal writing period (6) is entered after a transition period (5*b*), and a writing operation of the signal potential Vsig1 is carried out within the signal writing period (6). In the pixels in the Nth line, the transition period (5*b*) after the second time threshold voltage correction period (5) ends until the signal writing period (6) is entered is very short. Since some current leak occurs with the driving transistor T2 within the transition period (5*b*), the potentials of the gate G and the source S vary. However, since the transition period (5*b*) is very short, the influence of the current leak of the driving transistor T2 has little influence on the pixels in the Nth line, and little potential variation of the source S of the driving transistor T2 is found.

FIG. 15B illustrates potential variations of the gate G and the source S of the driving transistor T2 which belongs to the pixels in the N+1th line. The Nth line and the N+1th line belong to the same block as described above, and while a threshold voltage correction operation is carried out collectively in a unit of a block, a signal potential writing operation is carried out sequentially in each block. Therefore, the signal writing period (6) for the N+1th line is shifted rearwardly from the signal writing period (6) for the Nth line. Consequently, as seen from the timing chart of FIG. 15B, the transition period (5*b*) interposed between the second time threshold voltage correction period (5) and the signal writing period (6) is longer for the pixels in the N+1th line than for the pixels in the Nth line. Accordingly, the pixels in the N+1th line are influenced more by leak current of the driving transistor T2 and the potentials of the gate G and the source S of the driving transistor T2 rise as seen from a broken line circle in FIG. 15B. Particularly, the potential rise of the source S raises the gate G. Consequently, the dynamic range of the signal potential written into the storage capacitor C1 decreases and the pixels in the N+1th line do not exhibit desired luminance but exhibit lower luminance than the pixels in the Nth line.

When the operation for the block including the Nth line and the N+1th line comes to an end and operation for a next block is started, operation for the N+2th line and the N+3th line is repeated in a similar manner as in the operation for the Nth line and the N+1th line. In particular, the transition period of the pixels in the N+2th line is short, but the transition period from a threshold voltage correction period to a signal writing period in the pixels of the N+3th line is long. In the adjacent blocks, while the N+1th line and the N+2th line are adjacent each other, the transition period in the N+1th line is long while the transition period in the N+2th line is short. Accordingly, the transition period exhibits a great difference on the boundary between the blocks, and this gives rise to clear appearance of unevenness of the luminance on the boundary on the display image.

In the present invention, in order to cope with the problem just described, sequential control signals are outputted to different scanning lines so that line sequential scanning is carried out in the reverse directions to each other between adjacent blocks. Consequently, the transition time after a threshold voltage correction operation is completed until a signal potential writing operation is entered becomes equal in those pixels which belong to lines adjacent each other in adjacent blocks. Consequently, no difference appears in luminance between a pair of lines which are adjacent each other across the boundary between adjacent blocks, and a display image on which unevenness is not prominent is obtained.

Figure 15C:
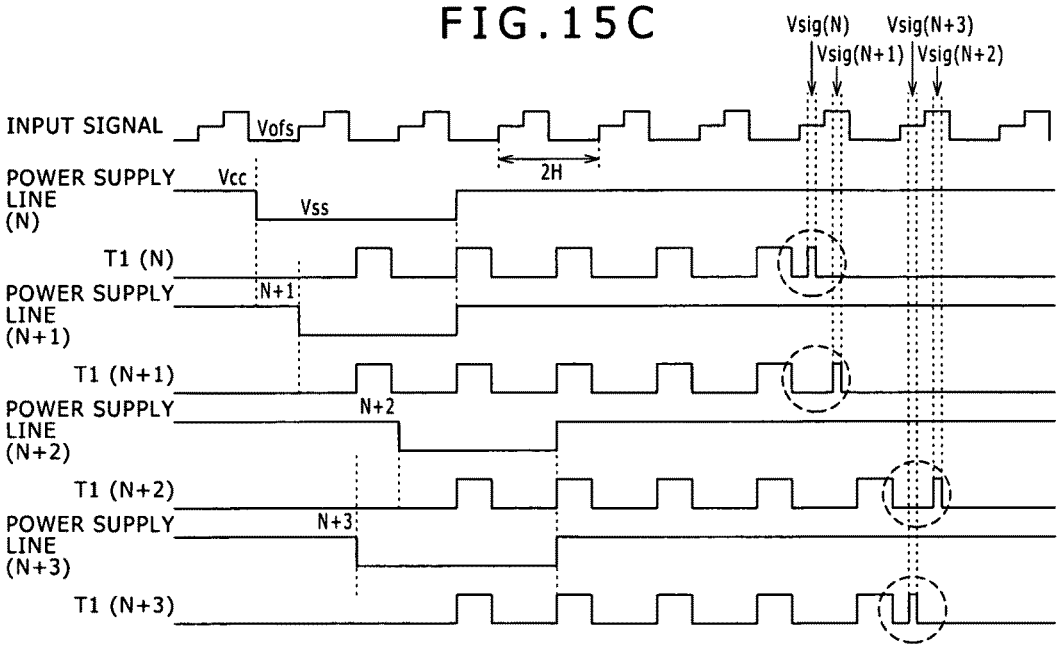
FIG. 15C is a timing chart illustrating a driving method for the display apparatus of FIG. 8A.

FIG. 15C illustrates an operation sequence of the display apparatus of FIG. 1. In the present embodiment, as an example, one block is composed of two scanning lines and two horizontal periods (2H) are combined to form one composite period. In the example of FIG. 15C, the Nth line and the N+1th line form one block, and the N+2th line and the N+3th line form a next block. Accordingly, the boundary between the adjacent blocks is positioned between the N+1th line and the N+2th line. As seen in FIG. 15C, the signal writing order and the power supply line potential changing over order as well as the signal inputting order are reversed between the adjacent blocks.

By reversing the directions of line sequential scanning, which is carried out upon signal writing, between adjacent blocks in this manner, the transition time after a threshold value correction operation is ended until a signal writing operation is entered is same between the N+1th line and the N+2th line. It is to be noted that, since the N+1th line and the N+2th line belong to different blocks from each other, the changeover timings for the power supply line (N) and the power supply line (N+2) have a phase difference of 2H. Also the phase difference of control signal pulses applied to the sampling transistors T1(N+1) and T1(N+2) is 2H which is one composite period. In conformity with this, the input signal varies in the order of Vsig(N), Vsig(N+1), Vsig(N+3) and Vsig(N+2). In other words, the signal potentials Vsig(N+3) and Vsig(N+2) are exchanged for each other in accordance with the reversal of line sequential scanning between the blocks.

By setting the transition time after a threshold voltage correction operation is ended until a signal writing operation is entered in such a manner as seen from the timing chart of FIG. 15C, the current leak amounts of the driving transistors of the pixels in the N+1th line and the N+2th line which belong to the blocks different from each other can be made substantially equal to each other. Consequently, the luminance difference between the pixels in the N+1th line and the pixels in the N+2th line which is visually observed in the reference example becomes less prominent. Consequently, uniform picture quality free from periodical unevenness can be obtained. In order to implement such a writing operation as just described, it is necessary to reverse the signal out between adjacent composite periods.

Figure 15D:
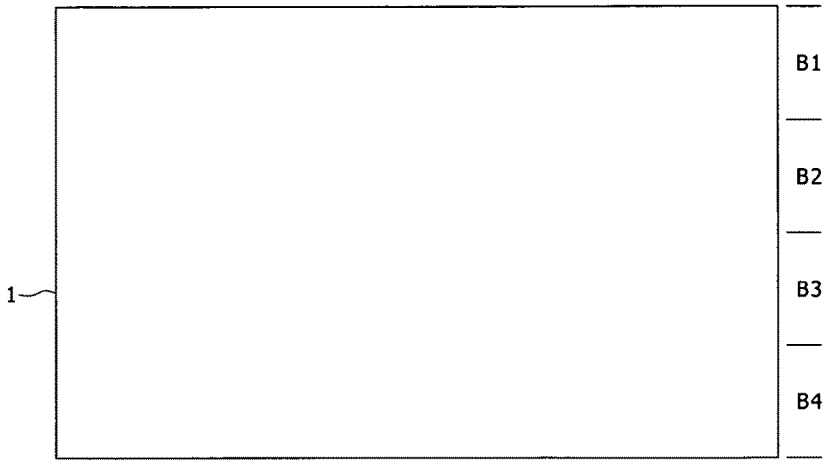
FIG. 15D is a schematic view showing a screen image of the display apparatus of the reference example.

FIG. 15D schematically shows a reference example of a screen image displayed on the pixel array section 1. The reference example is obtained by dividing 400 scanning lines formed on the pixel array section 1 for each 100 scanning lines into four blocks B1, B2, B3 and B4. As described hereinabove, a threshold voltage correction operation is carried out block-sequentially and all at once for each block. On the other hand, a signal potential writing operation is carried out line-sequentially in each block. In the present reference example, the line-sequential scanning direction is set to a downward direction from the top in each of the blocks B1 to B4. In other words, the direction of line sequential scanning is not reversed between adjacent blocks.

First, the threshold voltage correction operation is carried out collectively in the block B1, and then the line sequential scanning for signal writing is carried out in the downward direction. Since the transition time after a threshold value correction operation is ended until a signal writing operation is entered becomes longer downwardly, the current leak amount increases as much and the luminance drops. This is because, as the transition time becomes longer, the current leak increases and the luminance drops. In the following description, the transition time is re-defined as leak time for the convenience of description.

Then, the threshold voltage correction operation is carried out collectively again in the block B2, and then the signal writing operation is carried out by line sequential scanning. The direction of the line sequential scanning in the block B2 is same as in the block B1, that is, in the downward direction from the top. Therefore, in the block B2, the luminance gradually drops in the downward direction from the top.

Here, if attention is paid to the boundary between the block B1 and the block B2, then the leak time of the last line of the block B1 is longest. In the first line of the block B2 which is adjacent the last line of the block B1, the leak time is longest. Accordingly, the leak time differs most between the lines adjacent each other on the boundary between the block B1 and the block B2, and the great difference in luminance appears along the boundary. Accordingly, if the entire screen image of the pixel array section 1 is viewed, then striped unevenness is visually observed in a unit of a block, that is, for each of the blocks B1, B2, B3 and B4 as seen in FIG. 15D, and the uniformity of the screen image is not good.

Figure 15E:
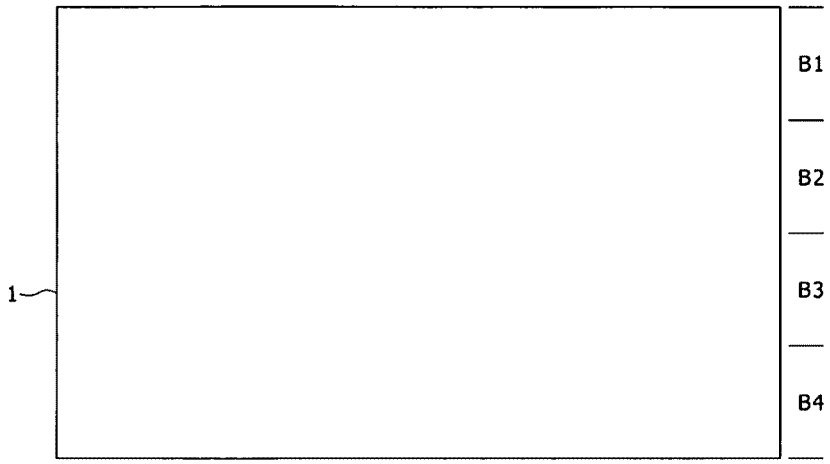
FIG. 15E is a similar view but showing a screen image of the display apparatus of FIG. 8A.

FIG. 15E schematically shows a screen image displayed on the pixel array section 1 in accordance with an operation sequence of the present invention. Similarly to the screen image shown in FIG. 15D, 400 scanning lines included in the pixel array section 1 are divided for each 100 scanning lines into four blocks B1, B2, B3 and B4. However, the directions of the line sequential scanning of the block B1 and the line sequential scanning of the block B2 are reverse to each other. Similarly, also between the blocks B2 and B3, the direction of the line sequential scanning is revered. Furthermore, also between the blocks B3 and B4, the direction of the line sequential scanning is reversed. If attention is paid to the first block B1, then the line sequential scanning for signal writing progresses in the downward direction from the top. Accordingly, the leak time of the last line of the block B1 is longest. Then, in the block B2, the line sequential scanning progresses conversely in the upward direction from the bottom. Therefore, the line positioned at the top of the block B2 exhibits the longest leak time. If attention is paid to the boundary between the block B1 and the block B2, then the leak time is longest in the lines adjacent each other across the boundary and the lines have no luminance difference. In other words, no luminance difference appears on the boundary between the block B1 and the block B2.

Then, if attention is paid to the boundary between the blocks B2 and B3, then the leak time of the last line on the block B2 side is shortest. Since the line sequential scanning in the block B3 progresses conversely in the upward direction from the bottom, the leak time of the first line in the block B3 is shortest. Therefore, the leak time is shortest in the lines adjacent each other on the boundary between the blocks B2 and B3 and no luminance difference appears between the lines. Accordingly, no prominent luminance unevenness appears between the blocks B2 and B3 and a uniform luminance distribution is obtained.

Figure 16:
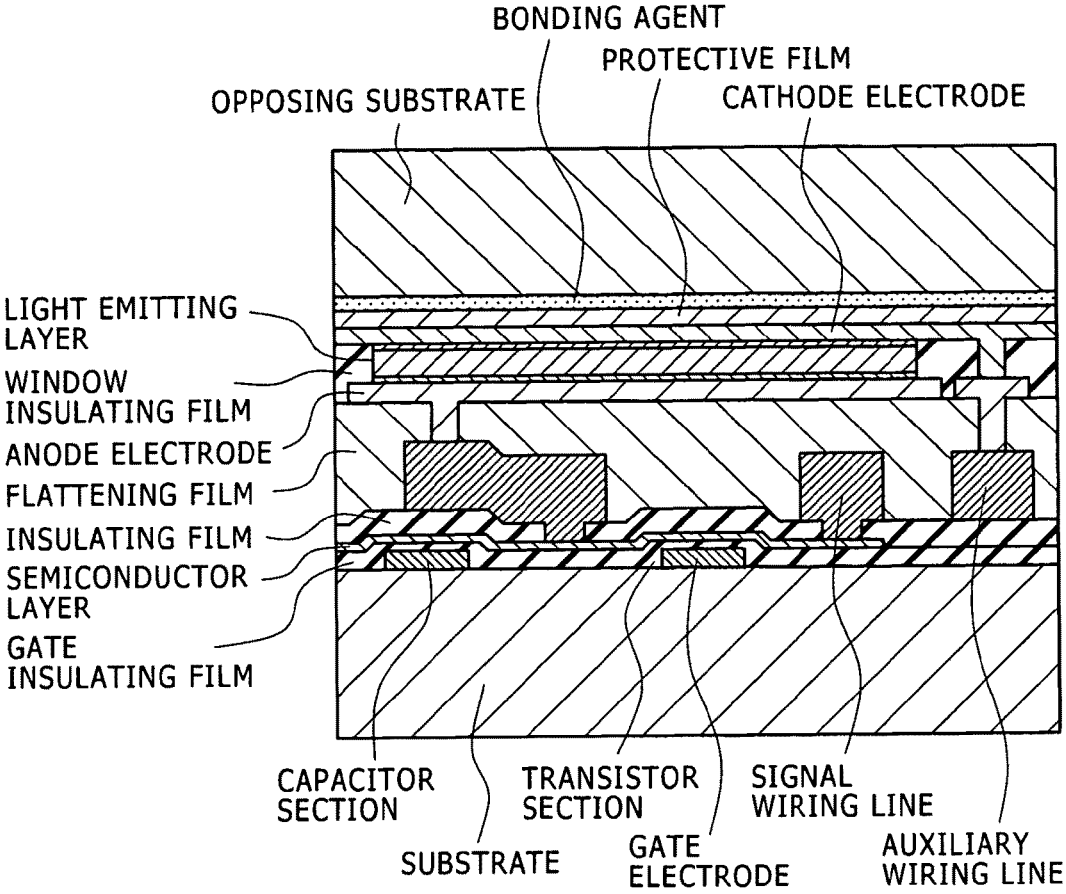
FIG. 16 is a sectional view showing a configuration of the display apparatus of FIG. 1.

The display apparatus according to the present invention has such a thin film device configuration as shown in FIG. 16. FIG. 16 shows a schematic sectional structure of a pixel formed on an insulating substrate. As seen in FIG. 16, the pixel shown includes a transistor section (in FIG. 16, one TFT is illustrated) including a plurality of thin film transistors, a capacitor section such as a storage capacitor or the like, and a light emitting section such as an organic EL element. The transistor section and the capacitor section are formed on the substrate by a TFT process, and the light emitting section such as an organic EL element is laminated on the transistor section and the capacitor section. A transparent opposing substrate is adhered to the light emitting section by a bonding agent to form a flat panel.

Figure 17:
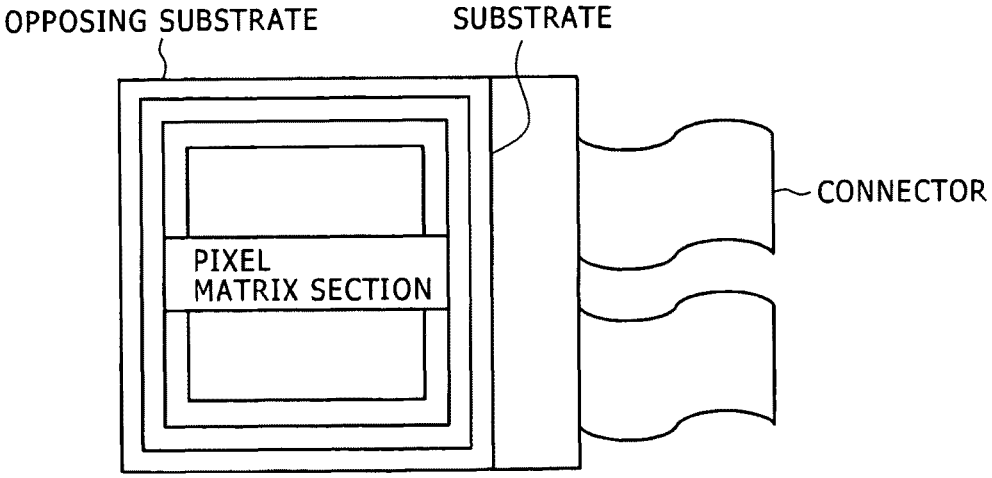
FIG. 17 is a plan view showing a module configuration of the display apparatus of FIG. 1.

The display apparatus of the present embodiment includes such a display apparatus of a module type of a flat shape as seen in FIG. 17. Referring to FIG. 17, a display array section wherein a plurality of pixels each including an organic EL element, a thin film transistor, a thin film capacitor and so forth are formed and integrated in a matrix, for example, on an insulating substrate. A bonding agent is disposed in such a manner as to surround the pixel array section or pixel matrix section, and an opposing substrate of glass or the like is adhered to form a display module. As occasion demands, a color filter, a protective film, a light intercepting film and so forth may be provided on this transparent opposing substrate. As a connector for inputting and outputting signals and so forth from the outside to the pixel array section and vice versa, for example, a flexible printed circuit (FPC) may be provided on the display module.

The display apparatus according to the present invention described above has a form of a flat panel and can be applied as a display apparatus of various electric apparatus in various fields wherein an image signal inputted to or produced in the electronic apparatus is displayed as an image, such as, for example, digital cameras, notebook type personal computers, portable telephone sets and video cameras. In the following, examples of the electronic apparatus to which the display apparatus is applied are described.

Figure 18:
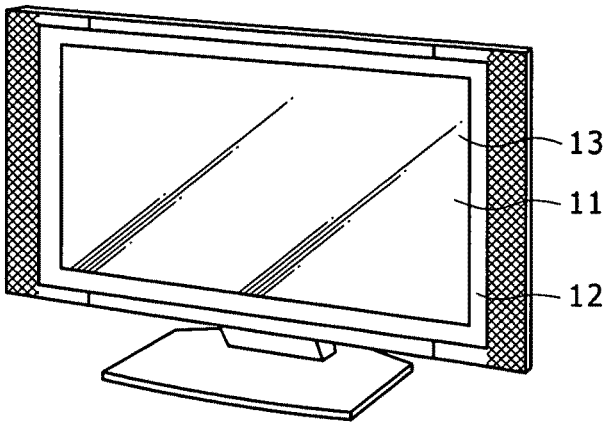
FIG. 18 is a perspective view showing a television set which includes the display apparatus shown in FIG. 1.

FIG. 18 shows a television set to which the present invention is applied. Referring to FIG. 18, the television set includes a front panel 12 and an image display screen 11 formed from a filter glass plate 3 and so forth and is produced using the display apparatus of the present invention as the image display screen 11.

Figure 19:
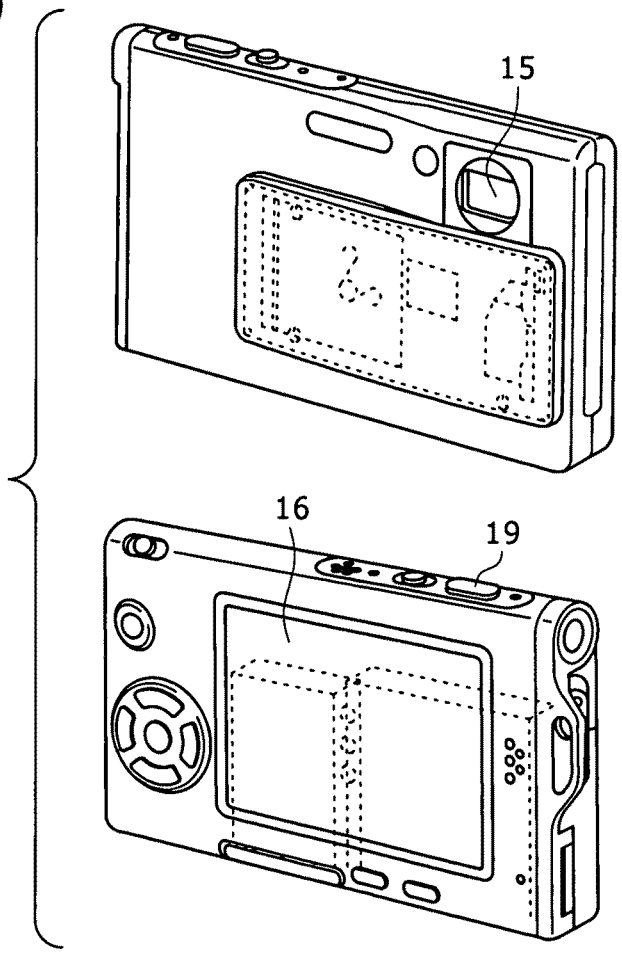
FIG. 19 is perspective views showing a digital still camera which includes the display apparatus shown in FIG. 1.

FIG. 19 shows a digital camera to which the present invention is applied. Referring to FIG. 19, a front elevational view of the digital camera is shown on the upper side, and a rear elevational view of the digital camera is shown on the lower side. The digital camera shown includes an image pickup lens, a flash light emitting section 15, a display section 16, a control switch, a menu switch, a shutter 19 and so forth. The digital camera is produced using the display apparatus of the present invention as the display section 16.

Figure 20:
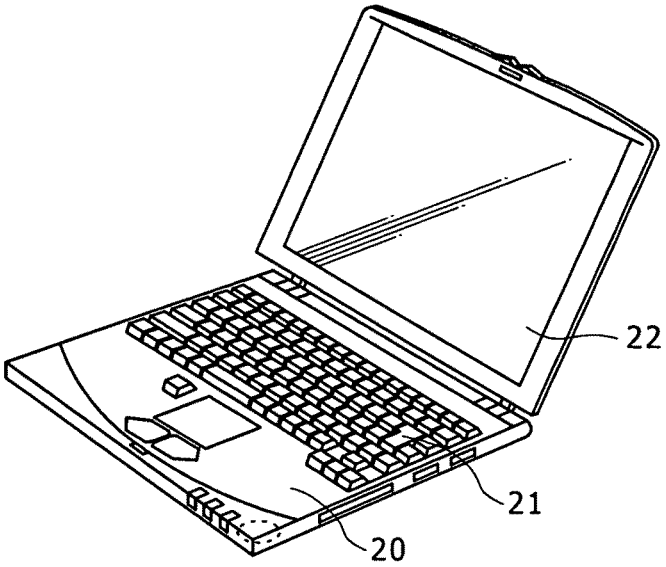
FIG. 20 is a perspective view showing a notebook type personal computer which includes the display apparatus shown in FIG. 1.

FIG. 20 shows a notebook type personal computer to which the present invention is applied. Referring to FIG. 20, the notebook type personal computer shown includes a body 20, a keyboard 21 for being operated in order to input characters and so forth, a display section 22 provided on a body cover for displaying an image and so forth. The notebook type personal computer is produced using the display apparatus of the present invention as the display section 22.

Figure 21:
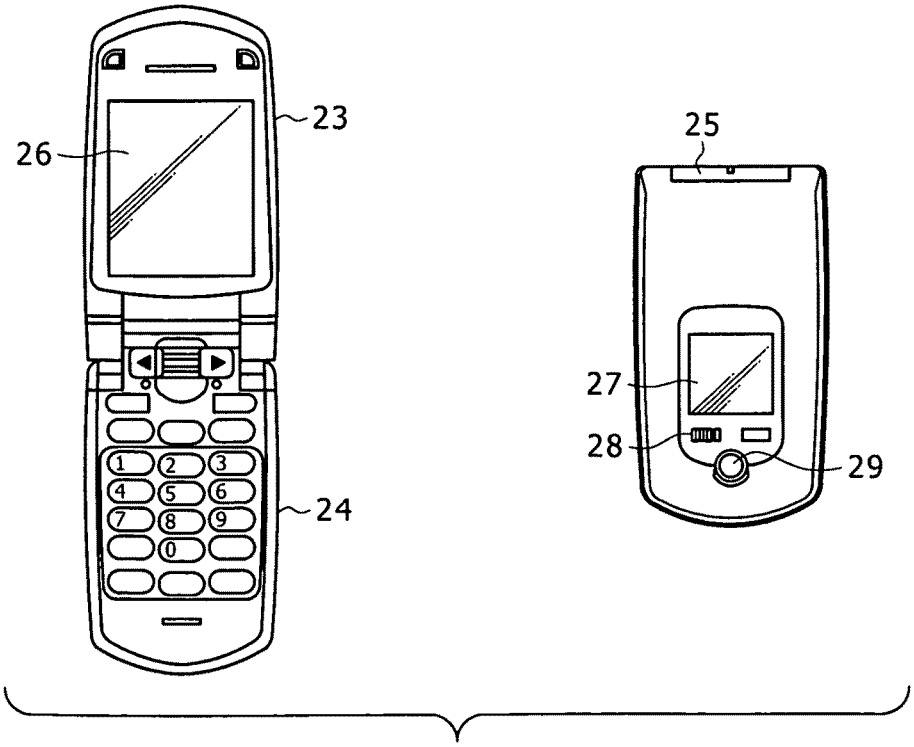
FIG. 21 is a schematic view showing a portable terminal apparatus which includes the display apparatus shown in FIG. 1.

FIG. 21 shows a portable terminal apparatus to which the present invention is applied. Referring to FIG. 21, the portable terminal apparatus is shown in an unfolded state on the left side and shown in a folded state on the right side. The portable terminal apparatus includes an upper side housing 23, a lower side housing 24, a connection section 25 in the form of a hinge section, a display section 26, a sub display section 27, a picture light 28, a camera 29 and so forth. The portable terminal apparatus is produced using the display apparatus of the present invention as the sub display section 27.

Figure 22:
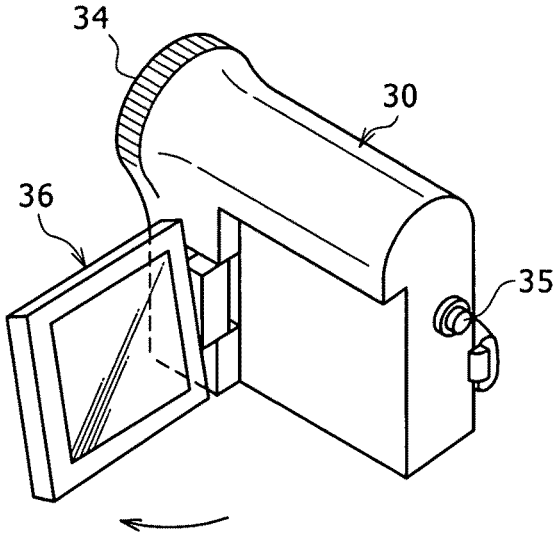
FIG. 22 is a perspective view showing a video camera which includes the display apparatus shown in FIG. 1.
Figure 23:
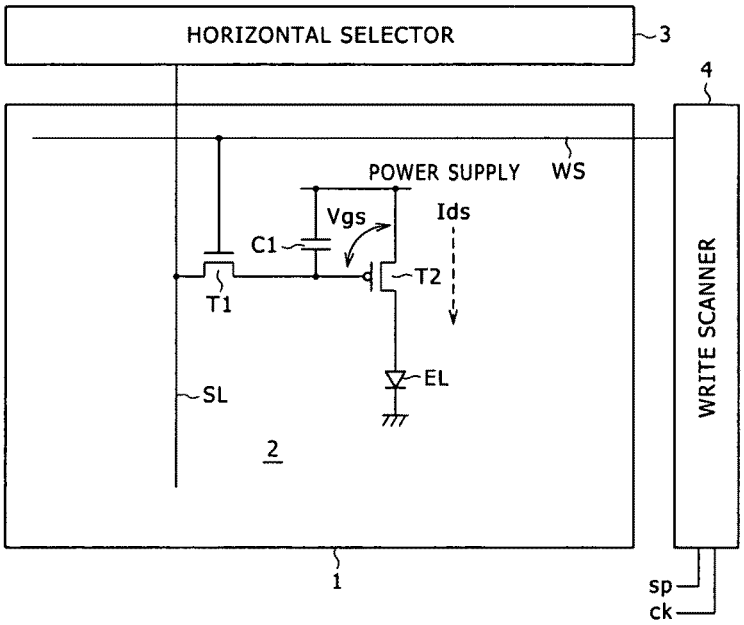
FIG. 23 is a circuit diagram showing an example of a existing display apparatus.
Figure 24:
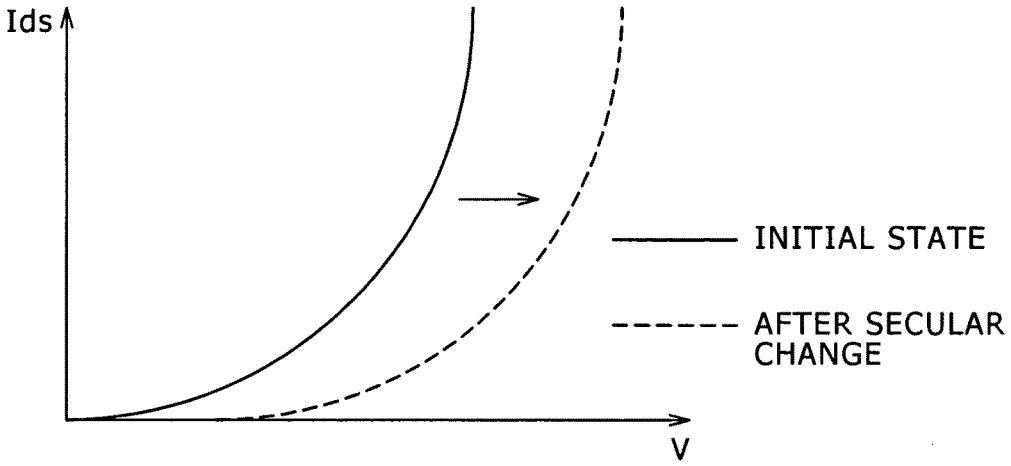
FIG. 24 is a graph illustrating a problem of the existing display apparatus of FIG. 23.
Figure 25:
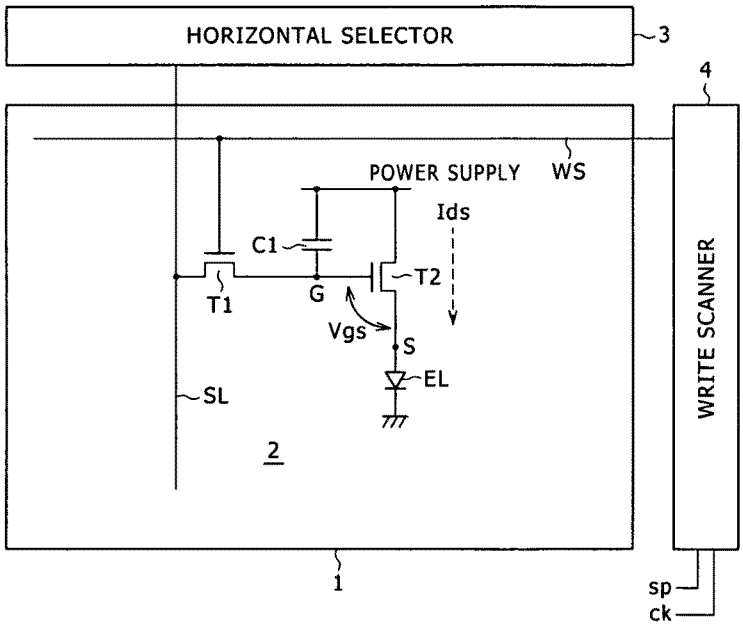
FIG. 25 is a circuit diagram showing another example of a existing display apparatus.

FIG. 22 shows a video camera to which the present invention is applied. Referring to FIG. 22, the video camera shown includes a body section 30, and a lens 34 for picking up an image of an image pickup object, a start/stop switch 35 for image pickup, a monitor 36 and so forth provided on a face of the body section 30 which is directed forwardly. The video camera is produced using the display apparatus of the present invention as the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus, comprising:

a pixel array section including a plurality of scanning lines disposed in rows, a plurality of signal lines disposed in columns, and a plurality of pixels arranged in rows and columns at places at which the scanning lines and the signal lines intersect with each other; and a driving section configured to drive the pixels through the scanning lines and the signal lines;

the driving section carrying out block-sequential driving wherein the scanning lines are grouped in a predetermined number to form blocks and the pixels disposed in rows and columns are sequentially driven in a unit of a block and line-sequential driving wherein the scanning lines are scanned in each of the blocks to sequentially drive the pixels in a unit of a row;

the driving section carrying out the block-sequential driving and the line-sequential driving such that the scanning direction of the line-sequential driving is reversed between each adjacent ones of the blocks, and the driving section drives the scanning lines in an order of a first scanning line to a last scanning line in a first block and then in an order of a last scanning line to a first scanning line in a second block adjacent to the first block, wherein the plurality of scanning lines of the pixel array section are divided according to the predetermined number into blocks while scanning periods individually allocated to each group of the plurality of scanning lines is combined to form a composite period including a first period and a second period, and wherein each of the pixels includes a sampling transistor, a driving transistor, a storage capacitor and a light emitting element;

the sampling transistor being connected at a control terminal thereof to an associated one of the scanning lines and at a pair of current terminals thereof to a first one of the signal lines and a control terminal of the driving transistor;

the driving transistor being connected at a first one of a pair of current terminals thereof to the light emitting element and at a second one of the current terminals thereof to a power supply;

the storage capacitor being connected between the control terminal and one of the current terminals of the driving transistor;

the driving section including a write scanner for supplying control signals to the scanning lines and a signal selector for switchably supplying a signal potential and a reference potential to the signal lines;

the sampling transistor carrying out a threshold voltage correction operation in response to a control signal supplied to the associated scanning line when the associated signal line has the reference potential to write a voltage corresponding to a threshold voltage of the driving transistor into the storage capacitor and then a signal potential writing operation in response to a control signal supplied to the associated scanning line when the associated signal line has the signal potential to sample an image signal from the associated signal line and write the sampled image signal to the storage capacitor;

the driving transistor supplying current in response to the signal potential written in the storage capacitor to the light emitting element to cause the light emitting element to emit light;

the write scanner selecting the blocks individually for sequential composite periods to scan the pixel array section;

the write scanner supplying, within the first period of each composite period, control signals all at once to the predetermined number of scanning lines which belong to one of the blocks to execute a threshold voltage correction operation in a unit of a block;

the write scanner outputting, within the second period of each composite period, sequential control signals to the predetermined number of scanning lines which belong to one of the blocks to carry out line sequential scanning thereby to execute a sequential signal potential writing operation in a unit of a row; and the write scanner outputting the sequential control signals such that the line sequential scanning of the scanning lines is carried out in the reverse directions to each other between adjacent ones of the blocks.

2. The display apparatus according to claim 1, wherein the driving section includes the signal selector configured to supply the image signal having the signal potential corresponding to a gradation and a predetermined reference potential to the signal lines disposed in columns, the write scanner configured to supply one of the sequential control signals to the scanning lines disposed in rows, and a drive scanner configured to supply a power supply voltage which changes over between a high potential and a low potential to a plurality of feed lines disposed in parallel to the scanning lines;

each of the pixels including the sampling transistor connected at a first one of the pair of current terminals thereof to one of the signal lines and at the control terminal thereof to one of the scanning lines, the driving transistor connected at a first one of the pair of current terminals thereof, which becomes the drain side, connected to one of the feed lines and at the control terminal thereof, which becomes a gate, to a second one of the pair of current terminals of the sampling transistor, the light emitting element connected to a second one of the pair of current terminals of the driving transistor which becomes the source side, and the storage capacitor connected between the source and the gate of the driving transistor;

the drive scanner grouping the feed lines disposed in rows for each predetermined number to form blocks such that the power supply voltage is changed over between the high potential and the low potential with the phase thereof displaced in order to carry out block-sequential driving in a unit of a block and the potential of the predetermined number of feed lines in each block is changed over in the same phase;

the write scanner carrying out the line-sequential scanning of sequentially supplying the control signal to the scanning lines in each block for each horizontal period such that the scanning direction of the line-sequential driving is reversed between each adjacent ones of the blocks.

3. The display apparatus according to claim 2, wherein the drive scanner carries out, in the block-sequential driving, a correction preparation operation of changing over the potential of the feed lines all at once from the high potential to the low potential to lower the source voltage of the driving transistors and then returning the potential of the feed lines all at once from the low potential to the high potential; and the write scanner carries out, in the line-sequential driving, a correction operation of supplying, when the pertaining signal line has the reference potential, the control signal to the scanning lines to turn on the sampling transistors to raise the source voltage of the driving transistors and discharging the storage capacitors so that the voltage between the gate and the source of the driving transistors varies toward a threshold voltage of the driving transistors.

4. The display apparatus according to claim 2, wherein the write scanner carries out, in the line-sequential driving, a writing operation of supplying, when the pertaining signal line has the signal potential, the control signal to the scanning lines and turning on the sampling transistors to write the signal potential into the storage capacitors, and the signal selector reverses the order of the signal potential to be supplied to the signal lines between each adjacent ones of the blocks.

5. The display apparatus according to claim 2, wherein the drive scanner includes a plurality of gate drivers individually corresponding to the blocks.

6. The display apparatus according to claim 1, wherein the write scanner is composed of a plurality of gate drivers individually corresponding to the blocks.

7. The display apparatus according to claim 1, wherein the time after the threshold voltage correction operation is completed until the signal writing operation is entered is equal between those pixels which below to rows adjacent each other between adjacent ones of the blocks.

8. An electronic apparatus, comprising:

a body section; and a display section configured to display information to be inputted to the body section or information outputted from the body section;

the display apparatus including a pixel array section including a plurality of scanning lines disposed in rows, a plurality of signal lines disposed in columns, and a plurality of pixels arranged in rows and columns at places at which the scanning lines and the signal lines intersect with each other; and a driving section configured to drive the pixels through the scanning lines and the signal lines;

the driving section carrying out block-sequential driving wherein the scanning lines are grouped in a predetermined number to form blocks and the pixels disposed in rows and columns are sequentially driven in a unit of a block and line-sequential driving wherein the scanning lines are scanned in each of the blocks to sequentially drive the pixels in a unit of a row;

the driving section carrying out the block-sequential driving and the line-sequential driving such that the scanning direction of the line-sequential driving is reversed between each adjacent ones of the blocks, and the driving section drives the scanning lines in an order of a first scanning line to a last scanning line in a first block and then in an order of a last scanning line to a first scanning line in a second block adjacent to the first block, wherein the plurality of scanning lines of the pixel array section are divided according to the predetermined number into blocks while scanning periods individually allocated to each group of the plurality of scanning lines is combined to form a composite period including a first period and a second period, and wherein each of the pixels includes a sampling transistor, a driving transistor, a storage capacitor and a light emitting element;

the sampling transistor being connected at a control terminal thereof to an associated one of the scanning lines and at a pair of current terminals thereof to a first one of the signal lines and a control terminal of the driving transistor;

the driving transistor being connected at a first one of a pair of current terminals thereof to the light emitting element and at a second one of the current terminals thereof to a power supply;

the storage capacitor being connected between the control terminal and one of the current terminals of the driving transistor;

the driving section including a write scanner for supplying control signals to the scanning lines and a signal selector for switchably supplying a signal potential and a reference potential to the signal lines;

the sampling transistor carrying out a threshold voltage correction operation in response to a control signal supplied to the associated scanning line when the associated signal line has the reference potential to write a voltage corresponding to a threshold voltage of the driving transistor into the storage capacitor and then a signal potential writing operation in response to a control signal supplied to the associated scanning line when the associated signal line has the signal potential to sample an image signal from the associated signal line and write the sampled image signal to the storage capacitor;

the driving transistor supplying current in response to the signal potential written in the storage capacitor to the light emitting element to cause the light emitting element to emit light;

the write scanner selecting the blocks individually for sequential composite periods to scan the pixel array section;

the write scanner supplying, within the first period of each composite period, control signals all at once to the predetermined number of scanning lines which belong to one of the blocks to execute a threshold voltage correction operation in a unit of a block;

the write scanner outputting, within the second period of each composite period, sequential control signals to the predetermined number of scanning lines which belong to one of the blocks to carry out line sequential scanning thereby to execute a sequential signal potential writing operation in a unit of a row; and the write scanner outputting the sequential control signals such that the line sequential scanning of the scanning lines is carried out in the reverse directions to each other between adjacent ones of the blocks.

9. The electronic apparatus according to claim 8, wherein the driving section includes the signal selector configured to supply the image signal having the signal potential corresponding to a gradation and a predetermined reference potential to the signal lines disposed in columns, the write scanner configured to supply one of the sequential control signals to the scanning lines disposed in rows, and a drive scanner configured to supply a power supply voltage which changes over between a high potential and a low potential to a plurality of feed lines disposed in parallel to the scanning lines;

each of the pixels including the sampling transistor connected at a first one of the pair of current terminals thereof to one of the signal lines and at the control terminal thereof to one of the scanning lines, the driving transistor connected at a first one of the pair of current terminals thereof, which becomes the drain side, connected to one of the feed lines and at the control terminal thereof, which becomes a gate, to a second one of the pair of current terminals of the sampling transistor, the light emitting element connected to a second one of the pair of current terminals of the driving transistor which becomes the source side, and the storage capacitor connected between the source and the gate of the driving transistor;

the drive scanner grouping the feed lines disposed in rows for each predetermined number to form blocks such that the power supply voltage is changed over between the high potential and the low potential with the phase thereof displaced in order to carry out block-sequential driving in a unit of a block and the potential of the predetermined number of feed lines in each block is changed over in the same phase;

the write scanner carrying out the line-sequential scanning of sequentially supplying the control signal to the scanning lines in each block for each horizontal period such that the scanning direction of the line-sequential driving is reversed between each adjacent ones of the blocks.

10. The electronic apparatus according to claim 9, wherein the drive scanner carries out, in the block-sequential driving, a correction preparation operation of changing over the potential of the feed lines all at once from the high potential to the low potential to lower the source voltage of the driving transistors and then returning the potential of the feed lines all at once from the low potential to the high potential; and the write scanner carries out, in the line-sequential driving, a correction operation of supplying, when the pertaining signal line has the reference potential, the control signal to the scanning lines to turn on the sampling transistors to raise the source voltage of the driving transistors and discharging the storage capacitors so that the voltage between the gate and the source of the driving transistors varies toward a threshold voltage of the driving transistors.

11. The electronic apparatus according to claim 9, wherein the write scanner carries out, in the line-sequential driving, a writing operation of supplying, when the pertaining signal line has the signal potential, the control signal to the scanning lines and turning on the sampling transistors to write the signal potential into the storage capacitors, and the signal selector reverses the order of the signal potential to be supplied to the signal lines between each adjacent ones of the blocks.

12. The electronic apparatus according to claim 9, wherein the drive scanner includes a plurality of gate drivers individually corresponding to the blocks.

13. The electronic apparatus according to claim 12, wherein the write scanner is composed of a plurality of gate drivers individually corresponding to the blocks.

14. The electronic apparatus according to claim 12, wherein the time after the threshold voltage correction operation is completed until the signal writing operation is entered is equal between those pixels which belong to rows adjacent each other between adjacent ones of the blocks.

* * * * *